US007006774B2

(12) United States Patent
Saito et al.

(10) Patent No.: US 7,006,774 B2
(45) Date of Patent: Feb. 28, 2006

(54) IMAGE FORMING APPARATUS, WHEREIN VOLTAGES APPLIED TO DEVELOPER REGULATING MEMBERS ARE BASED ON RESPECTIVE VOLTAGES APPLIED TO DEVELOPER CARRYING MEMBERS

(75) Inventors: Masanobu Saito, Shizuoka-ken (JP); Seiji Yamaguchi, Mishima (JP); Yasunari Watanabe, Shizuoka-ken (JP); Kazunori Hashimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 152 days.

(21) Appl. No.: 10/714,636

(22) Filed: Nov. 18, 2003

(65) Prior Publication Data

US 2004/0146312 A1 Jul. 29, 2004

(30) Foreign Application Priority Data

Nov. 19, 2002 (JP) ..... 2002/335837
Oct. 28, 2003 (JP) ..... 2003/368025

(51) Int. Cl.
*G03G 15/01* (2006.01)
*G03G 15/06* (2006.01)
*G03G 15/08* (2006.01)

(52) U.S. Cl. ..... 399/55; 399/223; 399/284; 399/285

(58) Field of Classification Search ..... 399/274, 399/284, 270, 285, 53, 55, 44, 49, 223, 111, 399/112

See application file for complete search history.

(56) References Cited

U.S. PATENT DOCUMENTS

| | | | | |
|---|---|---|---|---|
| 3,965,862 | A * | 6/1976 | Yang et al. | 399/223 |
| 5,124,750 | A * | 6/1992 | Naito | 399/55 |
| 5,678,130 | A * | 10/1997 | Enomoto et al. | 399/55 |
| 6,167,212 | A | 12/2000 | Satoh et al. | 399/55 |
| 6,223,004 | B1 * | 4/2001 | Kodama | 399/44 |
| 6,272,306 | B1 | 8/2001 | Saito et al. | 399/270 |
| 6,278,849 | B1 * | 8/2001 | Kawasaki | 399/55 |
| 6,415,127 | B1 | 7/2002 | Yamamoto et al. | 399/284 |
| 2003/0077088 | A1 | 4/2003 | Adachi et al. | 399/129 |
| 2004/0141766 | A1 * | 7/2004 | Toyama | 399/55 X |

FOREIGN PATENT DOCUMENTS

| | | |
|---|---|---|
| JP | 06-019297 A * | 1/1994 |
| JP | 6-289703 | 10/1994 |

* cited by examiner

*Primary Examiner*—Sophia Chen
(74) *Attorney, Agent, or Firm*—Fitzpatrick, Cella, Harper & Scinto

(57) ABSTRACT

An image forming apparatus includes a plurality of developing devices, each of which includes a developer carrying member for carrying a developer to develop an electrostatic image formed on an image bearing member with a developer, and a developer regulating member for regulating the developer carried on the developer carrying member; a common voltage applying device for applying voltages to the developer regulating members, wherein the voltages are applied to the developer carrying members are variable independently from each other, and when at least one of the voltages varies, the voltage applied by the voltage applying device is capable of being changed.

45 Claims, 12 Drawing Sheets

IMAGE FORMING APPARATUS, WHEREIN VOLTAGES APPLIED TO DEVELOPER REGULATING MEMBERS ARE BASED ON RESPECTIVE VOLTAGES APPLIED TO DEVELOPER CARRYING MEMBERS

FIELD OF THE INVENTION AND RELATED ART

The present invention relates to an image forming apparatus, such as a copying machine, a laser beam printer, etc., which employs an electrophotographic or electrostatic recording method.

In recent years, an electrophotographic image forming apparatus has been improved in process speed and functionality, and also, colorization is in progress in the field of an electrophotographic image forming apparatus. Thus, various image forming methods have been proposed for an image forming apparatus. From the standpoint of increasing process speed, an in-line type image forming apparatus in which multiple image formation stations (image formation units) different in the color in which they form an image, are arranged in a straight line, and are simultaneously driven to form an image, has been researched and developed. An image forming apparatus of this type is capable of forming a color image at a high speed, and therefore, it is thought to be extremely useful in the field of business, for example, in which the demand for high speed printing is great.

Some of the image forming apparatuses of this in-line type employ an image forming method which employs an intermediary transfer means. In this image forming method, multiple developer images (toner images) different in color are temporarily transferred (primary transfer) in layers onto an intermediary transfer medium, and then, are transferred (secondary transfer) all at once from the intermediary transfer medium onto a final transfer medium, for example, recording paper, OHP sheet, fabric, etc., yielding a permanent image.

FIG. 13 is a schematic sectional view of the essential portion of an image forming apparatus of the above described type. The image forming apparatus in FIG. 13 is not a specific type of an image forming apparatus. The image forming apparatus 200 in the drawing has multiple image forming means, for example, first to fourth image formation stations PY, PM, PC, and PBk for forming yellow (Y), magenta (M), cyan (C), and black (Bk) images, respectively. In operation, toner images are formed of toner as developer, on the electrophotographic photosensitive members 10Y, 10M, 10C, and 10Bk, as image bearing members, in the form of a drum (which hereinafter will be referred to as "photosensitive drum") of the image formation stations, respectively, and the toner images are transferred (primary transfer) in layers onto the intermediary transfer medium 31 by the functions of the primary transferring means 26Y, 26M, 26C, and 26Bk, in the primary transfer stations N1, respectively. Thereafter, the toner images on the intermediary transfer medium 31 are transferred all at once onto the final transfer medium S by the function of the secondary transferring means 32, in the secondary transfer station N2. During this secondary transfer, the transfer medium S is conveyed by the intermediary transfer medium 31 and the secondary transferring means 32, remaining pinched between them, with its front and back sides remaining in contact with the intermediary transfer medium 31 and secondary transferring means 32, respectively.

Next, the operation of the image formation stations of the image forming apparatus 200 in FIG. 13 will be described in more detail. All the image formation stations are virtually the same in structure, except that they are different in the color of the images they form. Thus, hereinafter, unless it is necessary to specifically mention the differences among them, their components will be described in generic terms, and, therefore, will not be given referential symbols which indicate to which image formation station a given component belongs.

In each image formation station, the photosensitive drum 10 is rotationally driven in the direction indicated by an arrow mark in the drawing. As it is rotationally driven, its peripheral surface is uniformly charged by the charge roller 11 as a charging means. Then, an electrostatic latent image, which reflects image formation signals, is formed across the uniformly charged portion of the peripheral surface of the photosensitive drum 10, by the exposing means (unshown). Then, this electrostatic latent image is developed by the developing means 13, which adheres toner to the electrostatic latent image. As a result, a visible image, which corresponds to the electrostatic latent image, is effected on the peripheral surface of the photosensitive drum 10.

The charge roller 11 is connected to a high voltage power source (unshown) through its electrodes. As voltage is applied to the charge roller 11, it uniformly charges the peripheral surface of the photosensitive drum 10 to a predetermined potential level. The charge roller 11 is kept pressed on the peripheral surface of the photosensitive drum 10 with the application of a predetermined amount of pressure, and charges the photosensitive drum 10 as it is rotated by the rotation of the photosensitive drum 10.

As the exposing means, a laser scanner (unshown), for example, is employed. It supplies optical signals modulated with the image formation signals from an image formation signal source, providing the numerous points on the uniformly charged portion of the peripheral surface of the photosensitive drum 10 with an optical signal L. As a result, an electrostatic latent image, which reflects the image formations signals, is formed on the peripheral surface of the photosensitive drum 10.

As for the developing means 13, there has been available such a means that comprises a development roller 16 as a developer bearing means for conveying developer to a photosensitive member, and develops the electrostatic latent image on the photosensitive drum 10 by placing the development roller 16 in contact with the photosensitive drum 10 (which hereinafter will be referred to as "contact developing method"). In this developing method, a visible image corresponding to the electrostatic latent image on the photosensitive drum 10 is formed on the photosensitive drum 10, by moving toner from the development roller 16 onto the electrostatic latent image on the photosensitive drum 10, adhering thereby the toner thereto, by the amount controlled by the relationship between the light potential level of the electrostatic latent image and the potential level of the bias voltage applied to the development roller 16.

A developing means (developing apparatus 13) employing this type of developing method has a contact development roller 16, a toner supply roller 18, and a development blade 17, which are disposed in the developer container (main frame of developing apparatus). The contact development roller 16 is placed in contact with the photosensitive drum 10. The developer supply roller 18 functions as a developer supplying member for supplying the development roller 16 with toner. The development blade 17 functions as a developer regulating member for regulating the toner supplied to the development roller 16. Further, the developing means is provided with a set of high voltage power sources (blade bias power sources) 22Y, 22M, 22C, and 22Bk, as voltage applying means, for applying voltage to the development blades 17, and a set of high voltage power sources (development bias power sources) 23Y, 23M, 23C, and 23Bk, as voltage applying means, for applying voltage to development rollers 16 and toner supply rollers 18.

Each development roller 16 is structured so that it is rotated by the rotation of the photosensitive drum 10 as it is placed in contact with the peripheral surface of the photosensitive drum 10. It is disposed so that it is partially exposed from the developer container 20.

Each development blade 17 is structured so that it is placed in contact with the development roller 16. The body of toner placed on the peripheral surface of the development roller 16 is forced through the contact area between the development blade 17 and development roller 16, being thereby regulated in thickness, forming therefore a thin layer of toner on the peripheral surface of the development roller 16. In addition, while the body of toner is forced through the contact area, the toner particles are given a satisfactory amount of triboelectric charge.

Each toner supply roller 18 is disposed upstream of the development blade 17 in terms of the rotational direction of the development roller 16, in contact with the development roller 16. It supplies the development roller 16 with developer by rotating in the direction (such a direction that, in contact area, peripheral surface of developer supply roller 18 moves in direction opposite to that in which peripheral surface of development roller 16 moves) indicated by an arrow mark in the drawing.

In some of the image forming apparatuses such as a laser beam printer shown in FIG. 13, the multiple image formation stations for forming multiple toner images, one for one, which are vertically arranged in a straight line, are in the form of a process cartridge removably mountable in the main assembly of an image forming apparatus. In other words, the photosensitive drum 10 as an image bearing member which is rotationally driven, the charge roller 11 as a charging means, the charge roller 11 as a charging means for uniformly charging the peripheral surface of the photosensitive drum 10, the developing apparatus 13 as a developing means for developing an electrostatic latent image into a visible image with the use of toner as developer, and the cleaning apparatus 14 as a cleaning means for cleaning the photosensitive drum 10, are integrally disposed in a cartridge (housing), effecting thereby a process cartridge 1 (1Y, 1M, 1C, and 1Bk), which is positioned in the image formation station (PY, PM, PC, and PBk). The configuration of the process cartridge does not need to be limited to the above described one, as long as a photosensitive member, and a minimum of one means among the charging means for charging the photosensitive member, developing means for supplying the photosensitive member with developer, and cleaning means for cleaning the photosensitive member, are integrally disposed in a cartridge removably mountable in the main assembly of an image forming apparatus. According to the process cartridge system, as a process cartridge having run out of one of the consumables, for example, developer, is replaced, other consumables such as a photosensitive drum are also replaced, drastically improving maintenance efficiency.

On the other hand, an electrophotographic image forming apparatus has its own problems. That is, the image density level at which an image is formed by an electrophotographic image forming apparatus is substantially affected by the temperature and humidity at which the apparatus is used, the nonuniformity in the photosensitive member properties and developer properties, the developing apparatus condition in terms of length of usage or wear. In particular, in the case of a color image forming apparatus, even the hue in which an image is formed is affected.

One of the image forming methods commonly practiced in consideration of the above described problems, is to execute such a control that stabilizes the image density level at which an image is formed (which hereinafter will be referred to as "density control"). More specifically, an image of a density level detection pattern (referential pattern) is formed in advance on an intermediary transfer medium or a final transfer medium, and the density level of the image is detected with the use of a density detection sensor (image density detecting means) 70. Then, the image formation conditions (factors) such as the potential levels of charge bias and development bias, amount of exposure, etc., which affects image formation process are controlled to stabilize the image formation density.

However, an image forming apparatus employing an in-line image formation method is provided with multiple developing apparatuses, as is the image forming apparatus shown in FIG. 13 provided with the four developing apparatuses 13Y, 13M, 13C, and 13Bk for yellow, magenta, cyan, and black colors, respectively, has the following problem. That is, in order to balance the four developing apparatuses in terms of image density (color density), four development bias power sources (23Y, 23M, 23C, and 23Bk), as voltage applying means for applying development bias to the development rollers 16, are required, one for each developing apparatus.

In addition, four blade bias power sources (22Y, 22M, 22C, and 22Bk), as voltage applying means for applying bias to the development blades 17 in accordance with the potential levels of the development biases applied to the development rollers 16, are provided, one for one. This is for the following reason. That is, in order to stabilize the amount by which toner is kept in a layer on the development roller 16, the difference in potential level between the development blade 17 and development roller 16 must be kept within a certain range. In other words, as the bias applied to each development roller 16 is changed during density control, the bias applied to the corresponding development blade 17 has also to be changed accordingly.

As will be evident from the above description, an in-line type image forming apparatus, such as the one described above, which has four developing apparatuses (13) requires four bias power sources for the four development blades 17.

Providing an image forming apparatus with multiple power sources requires the electrical circuit board of the apparatus to be increased in size, and also adds to apparatus cost, which is a problem.

An image forming apparatus which does not have multiple image formation stations, but in which bias voltage is applied to the development blade, has been known, being disclosed in Japanese Laid-open Patent Application 6-289703, for example.

SUMMARY OF THE INVENTION

The primary object of the present invention is to provide an image forming apparatus comprising a single voltage applying means that is shared by multiple developer regulating members to which voltage is applied.

Another object of the present invention is to provide an image forming apparatus capable of properly developing an electrostatic latent image in each of its multiple developing apparatuses.

Another object of the present invention is to provide an image forming apparatus capable of individually changing the voltages to be applied to the above described multiple developer bearing members.

Another object of the present invention is to provide an image forming apparatus capable of stabilizing the density level, at which it forms an image, by preventing the amount, by which developer is supplied to the developer bearing member, from fluctuating.

Another object of the present invention is to provide an image forming apparatus having such a voltage applying means that is shared by multiple developer regulating members to which voltage is applied, and capable of preventing the developer bearing members from being supplied with an insufficient amount of developer, or preventing developer from solidly adhering to the developer regulating members.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiment of the present invention will be described in detail with reference to the appended drawings.

Embodiment 1

The present invention is embodied in the form of an in-line type image forming apparatus employing a contact type developing method. This does not mean that the application of this embodiment is limited to an image forming apparatus of the above mentioned type. In other words, the present invention is applicable to any image forming apparatus in accordance with the following description of the preferred embodiments of the present invention, in terms of configuration as well as image formation method.

[General Structure of Image Forming Apparatus]

Figure 1:
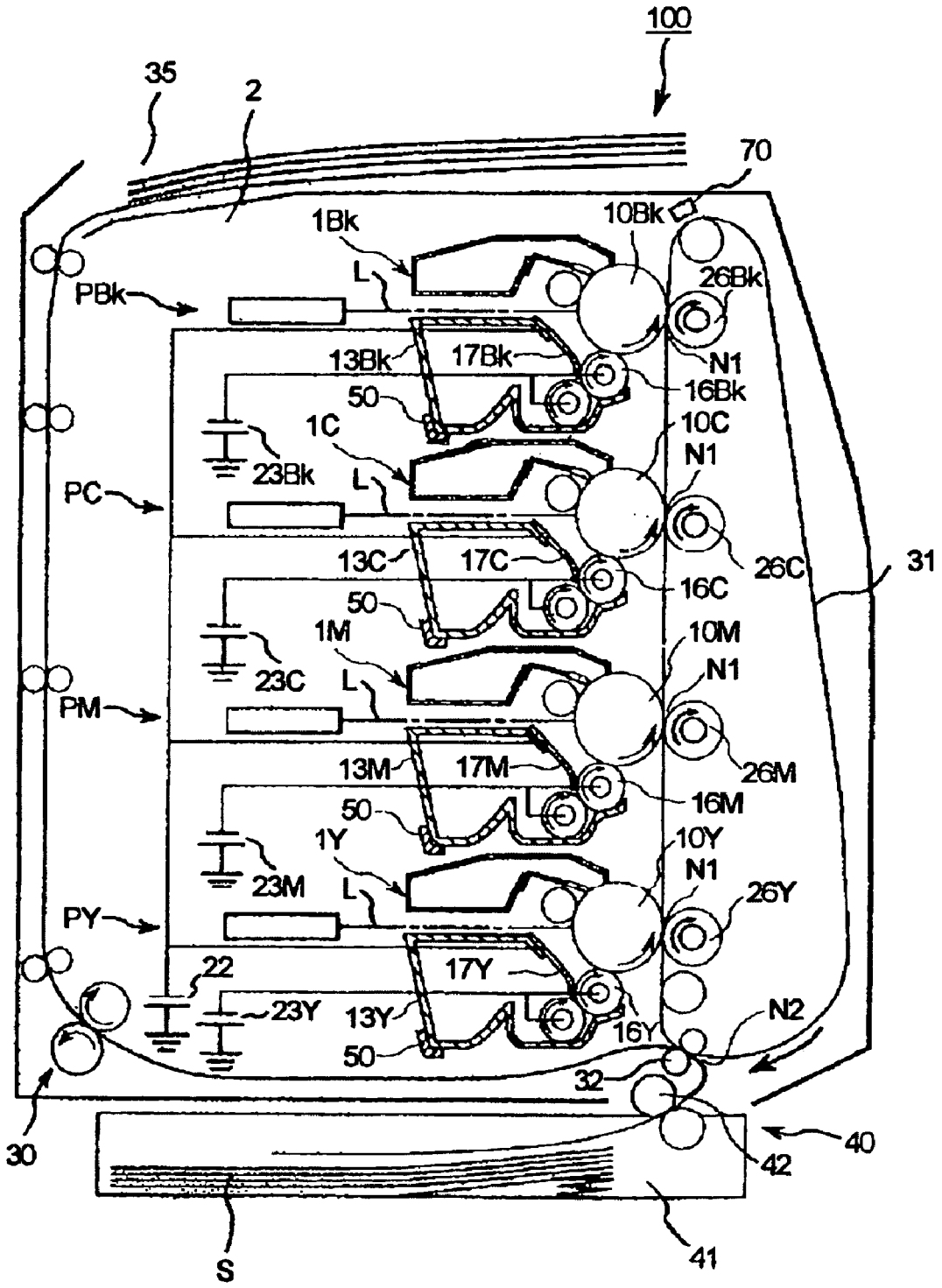
FIG. 1 is a schematic sectional view of the image forming apparatus in an embodiment of the present invention.

FIG. 1 is a schematic sectional view of the image forming apparatus 100 in this embodiment of the present invention. The image forming apparatus 100 in this embodiment is an electrophotographic image forming apparatus connected to an external host such as a personal computer. It is capable of outputting an image on a piece of transfer medium, for example, recording paper, OHP sheet, fabric, etc., in response to image formation data signals from the external host.

The image forming apparatus 100 has first to fourth image formation stations (image formation units) PY, PM, PC, and PBk, an image forming means, which form yellow (Y), magenta (M), cyan (C), and black (Bk) images, respectively. The four image formation units PY, PM, PC, and PBk are disposed in parallel, perpendicular to an intermediary transfer member (transfer belt) 31, as a transfer medium, which circularly moves in the direction indicated by an arrow mark in the drawing. More specifically, listing from the bottom in FIG. 1, yellow, magenta, cyan, and black image formation units PY, PM, PC, and PBk are vertically aligned in parallel with each other, and a full-color image is formed by sequentially transferring yellow, magenta, cyan, and black color images from the image formation units PY, PM, PC, and PBk, respectively onto the intermediary transfer belt 31, yielding thereby a full-color image, on the belt 31.

Figure 2:
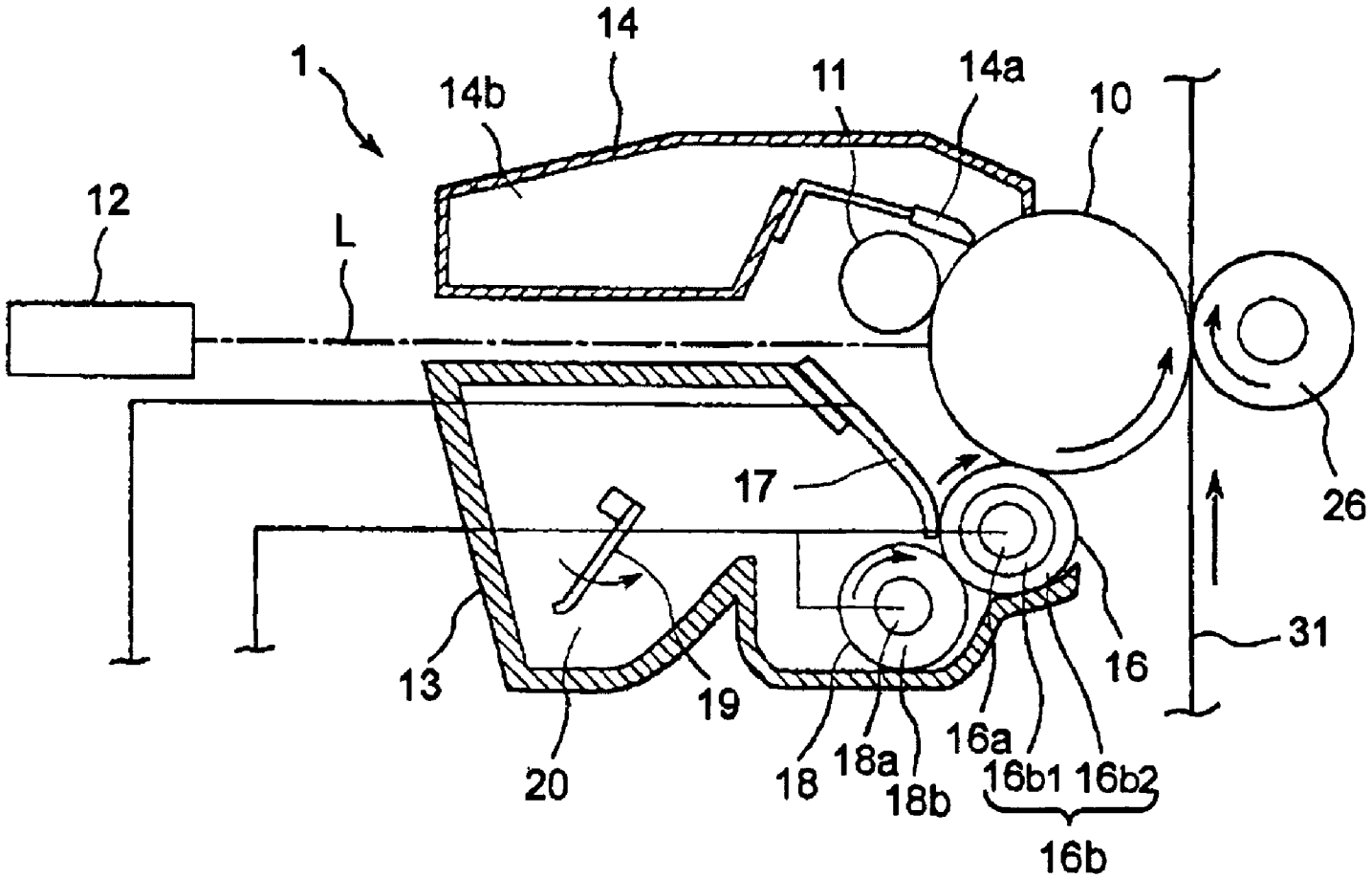
FIG. 2 is a detailed schematic sectional view of one of the image formation stations of the image forming apparatus in FIG. 1.

FIG. 2 shows in more detail one of the image formation stations. Incidentally, in this embodiment, all the image formation stations are virtually the same in structure, except that they are different in the color of the images they form. Thus, hereinafter, unless the differences are specifically noted, their components will be described in generic terms, and, therefore, will not be given referential symbols which indicate the colors of the image formation stations to which they belong.

Each image formation station is provided with an electrophotographic photosensitive member, as an image bearing member, in the form of a drum (photosensitive drum) 10. The peripheral surface of the photosensitive drum 10 is uniformly charged by a charge roller 11, as a charging means, which is rotated by the rotation of the photosensitive drum 10. Then, the charged portion of the peripheral surface of the photosensitive drum 10 is exposed to a scanning beam of light projected by an exposing apparatus 12, as an exposing means, while being modulated with the image formation data signals. As a result, an electrostatic latent image is formed on the peripheral surface of the photosensitive drum 10. To this electrostatic latent image, toner as developer is adhered by a developing apparatus 13 as a developing means, turning the latent image into a visible image (toner image), that is, an image formed of developer.

When forming a full-color image, toner images different in color are formed on the photosensitive drums 10 in the image formation stations, one for one, and as predetermined primary transfer biases are applied to the primary transfer rollers 26 as primary transferring means, the toner images on the photosensitive drums 10 are sequentially transferred in layers onto the intermediary transfer belt 31, in the primary transfer stations N1 of the image formation stations, in which the peripheral surfaces of the photosensitive drums 10 and primary transfer rollers 26 are in contact, or virtually in contact with, each other, one for one. As a result, a full-color image is formed on the intermediary transfer belt 31.

Next, a predetermined secondary transfer bias is applied to the secondary transfer roller 32 as a secondary transferring means, whereby the full-color image (combination of toner images) on the intermediary transfer belt 31 are transferred (secondary transfer) onto a final transfer medium S. The transfer medium S is fed into the main assembly of the image forming apparatus 100 from a transfer medium supply station 40 comprising a transfer medium cassette 41, a pair of transfer supply rollers 42 as a conveying means, etc., and is delivered, in synchronism with the transfer of the toner images onto the intermediary transfer belt 31, to the secondary transfer station N2, in Which the secondary transfer roller 32 opposes the intermediary transfer belt 31.

Thereafter, the transfer medium S onto which the toner images have just been transferred is conveyed to a fixing apparatus 30, in which the unfixed toner images are fixed to the transfer medium S. Then, the transfer medium S onto which the toner images have just been fixed is discharged into the delivery tray 35, ending the image formation.

Meanwhile, the primary transfer residual toner particles, that is, the toner particles which remained on the peripheral surface of the photosensitive drums 10 without being transferred during the primary transfer, are recovered into a waste toner container 14*b* by cleaning apparatuses 14, as image bearing member cleaning means, comprising a cleaning blade 14*a* as a cleaning member and the waste toner container 14*b*; the peripheral surfaces of the photosensitive drums 10 are cleaned. On the other hand, the secondary transfer residual toner particles, that is, the toner particles which remained on the intermediary transfer belt 31 without being transferred during the secondary transfer, are scraped away by an intermediary transfer member cleaning means (unshown) disposed so that it can be placed in contact with, or moved away from, the intermediary transfer belt 31; the surface of the intermediary transfer belt 31 is cleaned.

In this embodiment, each photosensitive member 10 is 30 mm in diameter, and is rotationally driven at a peripheral velocity of 100 mm/sec in the direction indicated by an arrow mark in the drawing. The peripheral surface of the photosensitive drum 10 is uniformly charged by the charge roller 11.

To each charge roller 11, a DC voltage of −150 V is applied from a charge bias power source (unshown), which is a high voltage power source, uniformly charging the peripheral surface of the photosensitive drum 10 to a potential level of roughly −600 V (dark point potential level). Although the charge bias used in this embodiment is DC bias, a combination of DC and AC components may be used as the charge bias.

Each exposing apparatus 12 exposes the peripheral surface of the photosensitive drum 10; more specifically, it scans the peripheral surface of the photosensitive drum 10 with a beam of laser light, which it projects, while turning it on and off in response to the image formation data inputted into the image forming apparatus. As a result, the exposed points on the peripheral surface of the photosensitive drum 10 are reduced in potential level to roughly −80 V (light point potential level), effecting thereby an electrostatic latent image, on the peripheral surface of the photosensitive drum 10.

Figure 13:
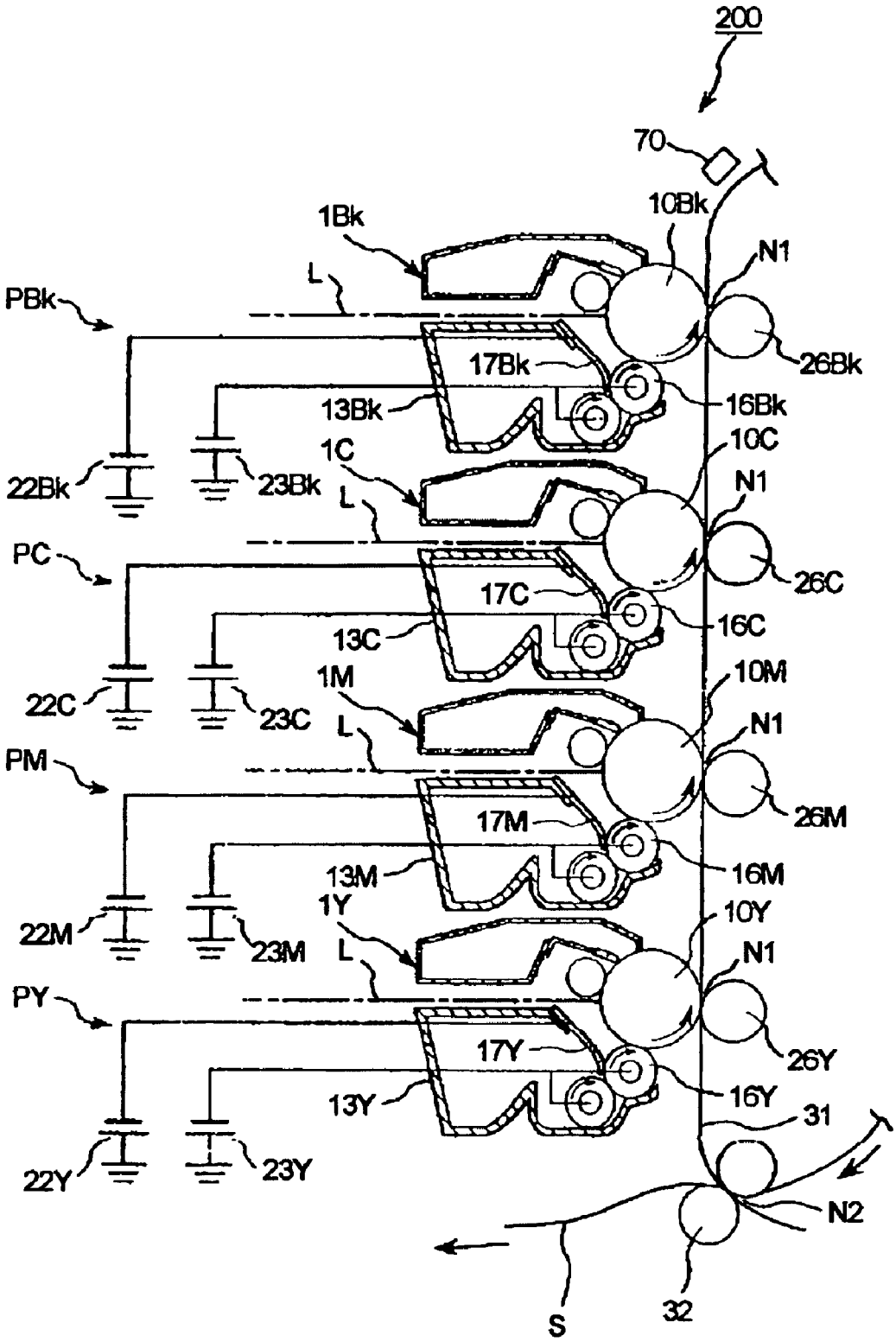
FIG. 13 is a schematic sectional view of the essential portion of an example of a known image forming apparatus.

Each developing apparatus 13 is roughly the same in structure as the one described above with reference to FIG. 13. It develops in reverse the electrostatic latent image on the photosensitive drum 10 with the use of a contact developing method, and a toner which is the same in polarity (which is negative in this embodiment) as the photosensitive drum 10.

Described in more detail with reference to FIG. 2, the developing apparatus 13 comprises: a developer container (developing apparatus main frame) 20, in which nonmagnetic toner as developer (single-component toner as single-component developer), is contained; a development roller 16 as a developer bearing member; a development blade 17 as a developer regulating member; a toner supply roller 18 as a developer supplying member; and a stirring blade 19 as a developer stirring/conveying means.

The development roller 16 in this embodiment comprises a metallic core 16*a*, and an elastic layer 16*b* formed on the peripheral surface of the metallic core 16*a*. It is 16 mm in external diameter. The metallic core 16*a* is formed of metal such as aluminum, aluminum alloy, etc., and the elastic layer 16*b* comprises a base layer 16*b*1, and a surface layer 16*b*2 layered on the base layer 16*b*1. The base layer 16*b*1 of the elastic layer 16*b* is formed of rubbery substance such as silicon rubber, and the surface layer 16*b*2 of the elastic layer 16*b* is formed of ether-urethane or nylon. Of course, the materials for these layers are not limited to those listed above; it is possible to employ foamed substance, for example, sponge, as the material for the base layer 16*b*1, and rubbery substance as the material for the surface layer 16*b*2. The electrical resistance of the development roller 16 was 1 MΩ, which was measured while the development roller 16 was kept pressed on a metallic cylinder with a diameter of 30 mm, applying the total weight of 1 kg, and while a voltage of 50 V was applied to the development roller. In this embodiment, the development roller 16 is rotationally driven by a driving means (unshown) at a peripheral velocity of 160 mm/sec.

The electrostatic latent image on the photosensitive drum 10 is developed into a visual image (image formed of toner) by the toner borne on the peripheral surface of the development roller 16 placed in contact with the peripheral surface of the photosensitive drum 10, forming a development station (contact area) between the development roller 16 and photosensitive drum 10. During this development process, which will be described later in detail, a negative DC voltage (development bias voltage) of roughly −250 V−−400 V is applied to the development roller 16 from a high voltage power source (development bias power source 23Y, 23M, 23C, or 23Bk), as a development voltage applying means, causing the negatively charged toner particles to transfer from the development roller 16 onto the electrostatic latent image on the photosensitive drum 10. Incidentally, a combination of DC voltage and AC voltage may be applied as the development bias voltage to the development roller 16, instead of applying the DC voltage alone. The development bias power sources 23Y, 23M, 23C, and 23Bk are capable of changing the potential levels of the DC voltages they output.

As described above, in the case of an in-line developing method, four developing apparatuses 13 are present, which are adjustable in the density level at which they develop a latent image. This is why the four development bias power sources 23Y, 23M, 23C, and 23Bk, as voltage applying means, are provided, one for each of the four developing apparatuses 13.

There is a development blade 17 above the development roller 16. It is a member for regulating the amount by which developer is allowed to remain on the development roller 16, and is supported by the developer container 20, with its free long edge kept lightly in contact with the peripheral surface of the development roller 16.

In this embodiment, the development blade 17 is tilted, with its free long edge positioned upstream of the contact area between the development blade 17 and development roller 16, in terms of the rotational direction of the development roller 16; in other words, it is tilted in the so-called counter direction. More concretely, the development blade 17 is a piece of 0.1 mm thick phosphor bronze plate, which is springy. It is kept in contact with the peripheral surface of the development roller 16 so that a predetermined amount of pressure (linear pressure) is maintained between the development blade 17 and development roller 16. With the development blade 17 kept pressed against the peripheral surface of the development roller 16 in a manner to maintain the predetermined contact pressure between them, the toner particles are frictionally charged to the negative polarity.

Although this will be described later in more detail, a negative DC voltage (blade bias) of roughly −600 V is applied to the development blade 17 from a high voltage power source (blade bias power source) as a regulating member voltage applying means, in order to stabilize the amount by which toner is allowed to remain on the peripheral surface of the development roller 16. There is only one blade bias power source 22, which is capable of applying to all the development blades 17 in the developing apparatuses 13Y, 13M, 13C, and 13Bk of the image formation stations PY, PM, PC, and PBk for yellow, magenta, cyan, and black colors, respectively, biases identical in potential level value, which are variable.

Incidentally, in this embodiment, the development and blade biases are negative, and for the sake of convenience, the potential levels of the development and blade biases are expressed in absolute values. For example, that a given bias is greater than another bias mens that it is greater in absolute value; in this embodiment, therefore, it means that a given bias is greater in the negative direction than another bias.

The toner supply roller 18 may be in the form of a sponge roller, or a fur brush roller comprising a metallic core and rayon or nylon fibers planted on the peripheral surface of the metallic core. In this embodiment, an elastic roller with a diameter of 16 mm, which comprises a metallic core 18*a* and a urethane foam layer 18*b* wrapped around the core 18*a*, is employed as the toner supply roller 18, in consideration of the fact that toner is supplied to the development roller 16 from the toner supply roller 18, and also that the toner remaining on the development roller 16 without being consumed for development is to be stripped away from the development roller 16.

This toner supply roller 18, which is an elastic roller, is kept in contact with the development roller 16. During a development process, it is rotationally driven at a peripheral velocity of 100 mm/sec, in such a direction that, in the contact area between the peripheral surfaces of the toner supply roller 18 and development roller 16, the peripheral surface of the toner supply roller 18 moves in the direction opposite to the moving direction of the development roller 16. The distance of the apparent entry of the toner supply roller 18 into the development roller 16 is 1.5 mm.

As described above, the toner image on the peripheral surface of the photosensitive drum 10 is transferred onto the intermediary transfer belt 31 by a transfer roller 26 to which the primary transfer bias is being applied from a primary transfer bias applying means, and then, is transferred from the intermediary transfer belt 31 onto the transfer medium S by the secondary transfer roller 32 to which the secondary transfer bias is being applied from a secondary transfer bias power source (unshown) as a secondary transfer bias applying means. Thereafter, the toner image on the transfer medium S is fixed to the transfer medium S.

If the next set of image formation data is inputted into the image forming apparatus 100 immediately after the completion of the on-going image forming process, the following round of the image formation process is carried out, without interrupting the rotations of the photosensitive drum 10, development roller 16, toner supply roller 18, etc., and while keeping the development roller 16 the same in potential level.

In this embodiment, the developing apparatus 13, the photosensitive drum 10 which is rotationally driven, the charge roller 11 for uniformly charging the peripheral surface of the photosensitive drum 10, and the cleaning apparatus 14, are integrally disposed in a cartridge (housing), effecting thereby a process cartridge 1. Each of the process cartridges 1Y, 1M, 1C, and 1Bk different in the development color, is removably mountable in the main assembly 2 of the image forming apparatus 100, through the process cartridge mounting means 50 of the main assembly 2. In this embodiment, the frame of the process cartridge 1 comprises the waste toner container 14*b* and developer container 20, which are integrally joined with each other. The toner container 14*b* supports the photosensitive drum 10, charge roller 11, and cleaning blade 17, whereas the developer container 20 supports the development roller 16, development blade 17, toner supply roller 18, and stirring blade 19.

However, the design of the process cartridge 1 does not need to be limited to the above described one. For example, the developing apparatus 13 may be immovably attached to the main assembly 2 of an image forming apparatus, while a photosensitive member as an image bearing member, and a minimum of one means among a charging means for charging the photosensitive member, a developing means for supplying the photosensitive member with developer, and a cleaning means for cleaning the photosensitive member, are integrally disposed in a cartridge which is removably mountable in the main assembly of an image forming apparatus. On the other hand, only the developing apparatus 13 may be placed in a cartridge, effecting a development cartridge removably mountable in the image forming apparatus main assembly 2.

In this embodiment, as the process cartridge 1 is mounted into the image forming apparatus main assembly 2, the driving force transmitting means of the process cartridge 1 becomes connected with the driving means (unshown) of the image forming apparatus main assembly 2, making it possible to drive the photosensitive drum 10, developing apparatus 13, charge roller 11, etc. The power sources for applying voltage to the charge roller 11, development roller 16, development blade 17, etc., are provided on the image forming apparatus main assembly 2 side, and become connected, in terms of electricity conduction, with the charge roller 11, development roller 16, development blade 17, etc., respectively, through the contact points provided on the process cartridge 1 side and the contact points provided on the image forming apparatus main assembly 2 side, as the process cartridge 1 is mounted into the image forming apparatus main assembly 2.

Further, in this embodiment, the power sources (blade bias power source, development bias power sources, primary transfer bias power sources, secondary transfer bias power source, and charge bias power sources), with which the image forming apparatus 100 is provided, are controlled by a CPU 60 (FIG. 3), as a controlling means, for integrally controlling the overall operation of the image forming apparatus.

[Image Density Control]

Figure 3:
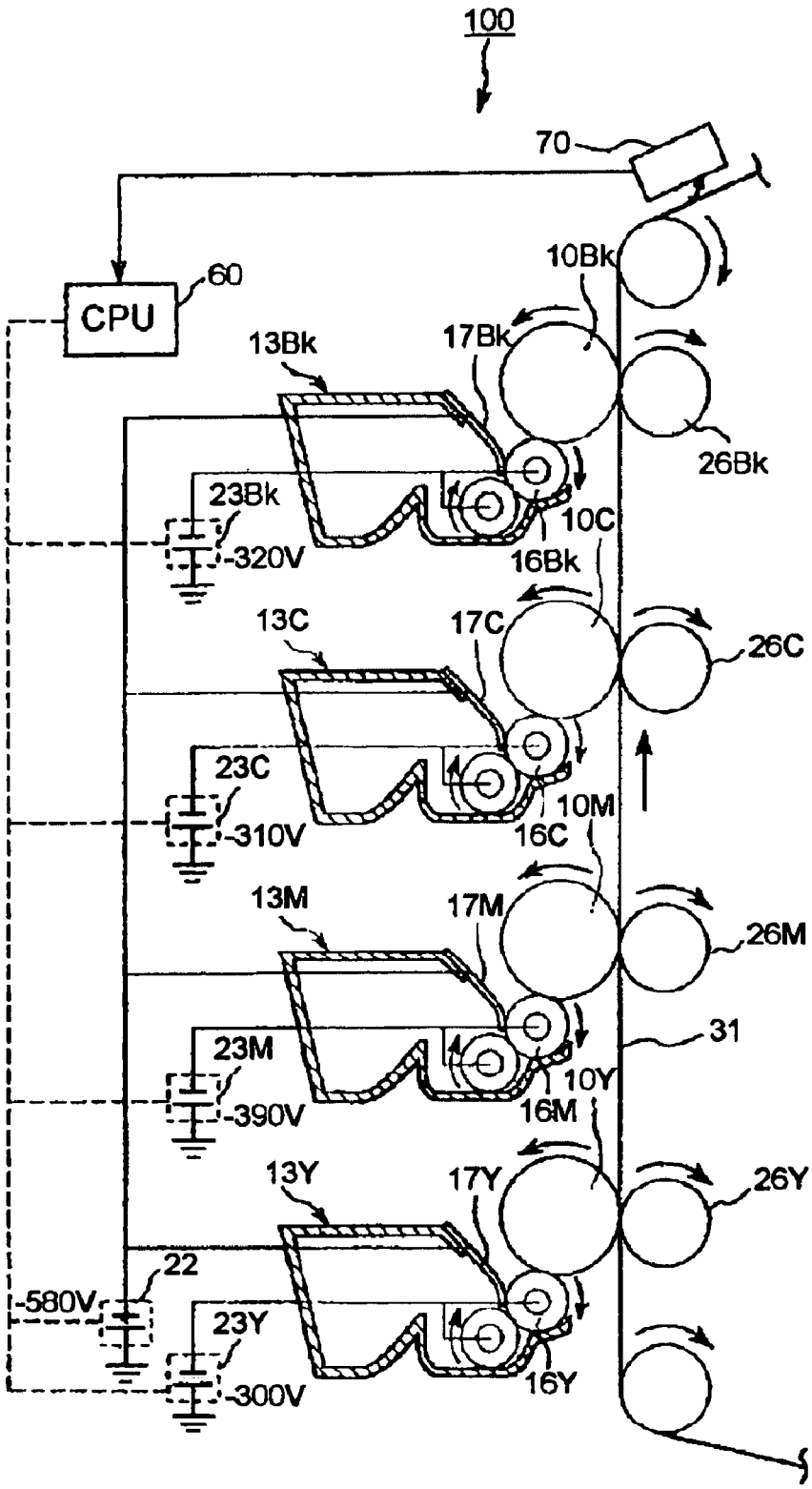
FIG. 3 is a schematic sectional view of the essential portion of the image forming apparatus, for describing the structure thereof, and how development bias and blade bias are applied.

Next, the density control in this embodiment will be described. FIG. 3 is a schematic sectional view of the essential portion, in particular, the portion comprising the photosensitive drum 10, developing apparatus 1, primary transfer roller 26, intermediary transfer belt 31, etc., of the image forming apparatus main assembly 2, for describing the structure thereof. In FIG. 3, the components other than the above mentioned are not shown.

Figure 4:
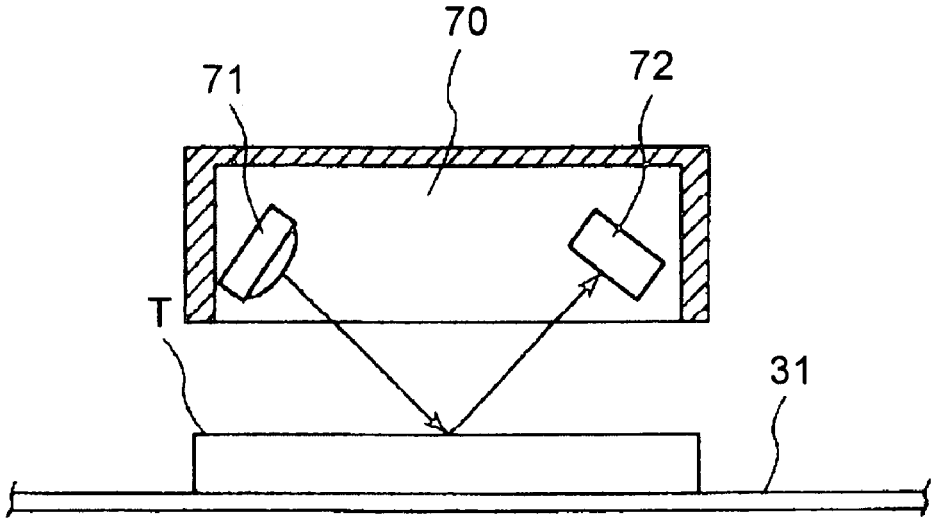
FIG. 4 is a schematic sectional view of an example of a density sensor.

The image forming apparatus 100 in this embodiment has a density sensor 70, as an image density level detecting means, which is a light sensor. Referring to FIG. 4, the density sensor 70 has a light emitting portion 71 and a light receiving portion 72. In operation, a spot of light is projected from the light emitting portion 71 onto the image of a density control patch (referential image) T having been transferred onto the surface of the intermediary transfer belt 31 after being formed on the photosensitive drum 10, with predetermined timing, and the light reflected by the image of the density control patch T is received by the light receiving portion 72, enabling thereby the density sensor 70 to determine the density level of the image, based on the amount of the light received by the light receiving portion 72. The CPU 60, as a controlling means, changes the image formation condition, rectifying thereby the density level at which the image forming apparatus forms an image, by changing, in potential level, the development bias applied to the developing apparatus 13, and the like factors, based on the amount of the received light, which is inputted from the light receiving portion 72 of the density sensor 70, that is, the output of the density sensor 70.

Figure 5:
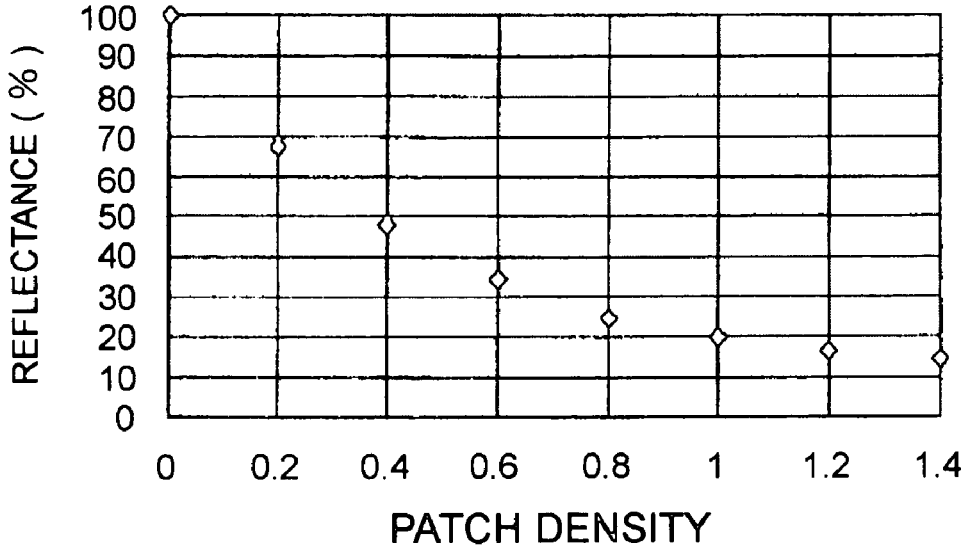
FIG. 5 is a graph for describing the relationship between the density level of the image of the density control patch and reflectivity.

FIG. 5 shows the relationship between the density level (which is reflection density level here, and also, hereafter) and reflectance. In FIG. 5, the amount of the light received by the light receiving portion 72 when no toner is on the intermediary transfer belt 31 is used as the referential reflectance level (100%). The reflectance levels plotted in FIG. 5 are the results of the measurement of the reflectance levels of the toner image on the intermediary transfer belt 31. The density levels plotted in FIG. 5 are the results of the measurement, in density level, of the toner images having been transferred onto the transfer medium S under identical conditions.

When the amount of the toner on the intermediary transfer belt 31 is zero, that is, when there is no toner on the intermediary transfer belt 31, the reflectance is 100%. As the amount of the toner on the intermediary transfer belt 31 increases, the reflectance of the intermediary transfer belt 31 reduces, that is, the amount of the light reflected toward the light receiving portion 72 reduces, because the light projected upon the intermediary transfer belt 31 from the light emitting portion 71 is diffused by the toner on the intermediary transfer belt 31.

All that is necessary to convert reflectance level into image density level is to look up the reflectance-density conversion table, which has been prepared through experiments, and has been stored in a storage means, for example, the storage portion of the CPU 60.

Next, referring to FIGS. 6–9, the density controlling method in this embodiment will be described in more detail.

Figure 6:
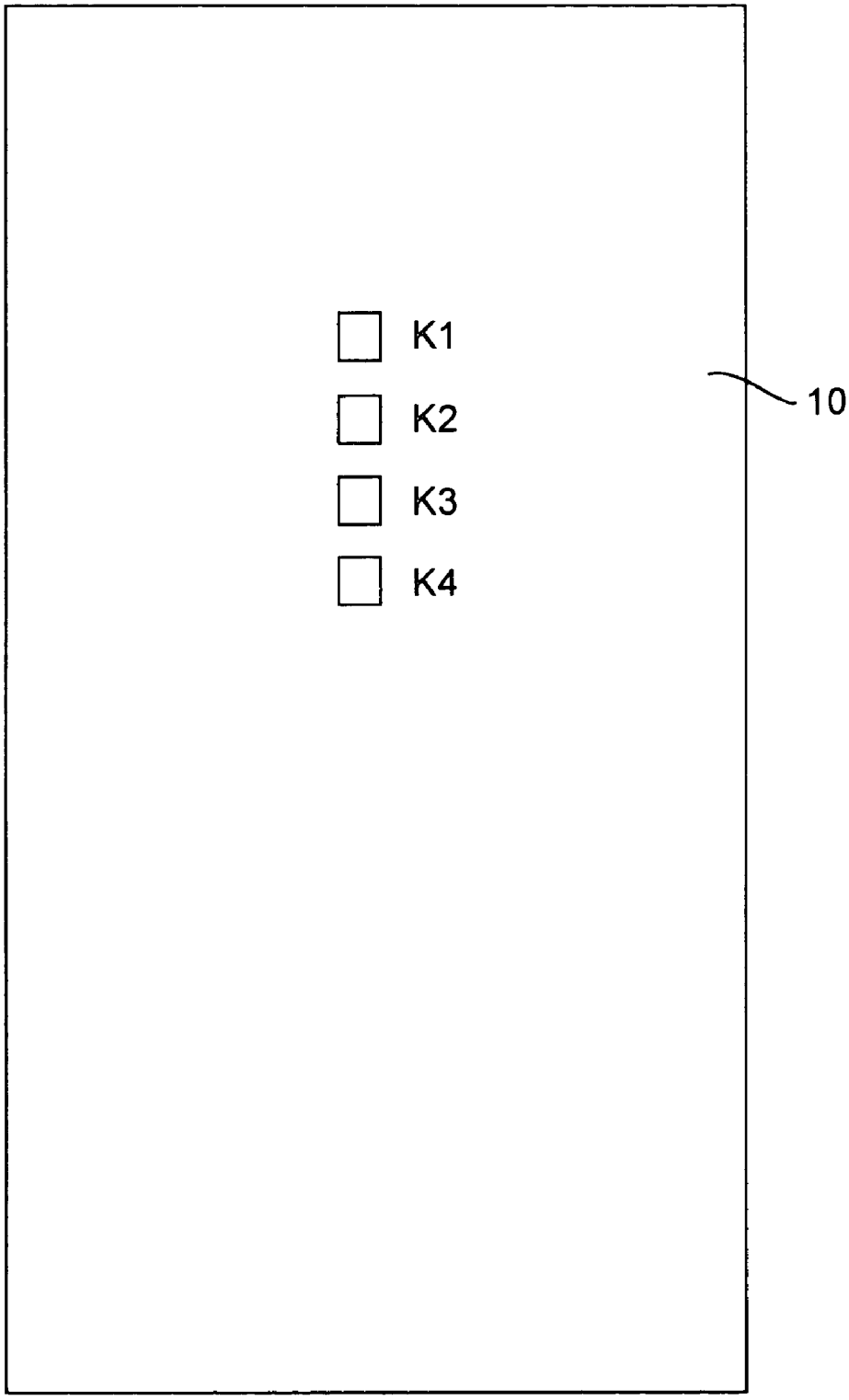
FIG. 6 is a development of a photosensitive drum, schematically showing the arrangement of the images of the density control patches formed on the peripheral surface of the photosensitive drum.

First, the density control process in this embodiment is initiated by the CPU 60, once every predetermined number of prints, at a predetermined point in time during one of the periods in which an image is not actually formed, for example, the intervals (so-called paper intervals) between two consecutive transfer mediums S when a large number of prints are continuously produced, preparatory periods (so-called post-rotation periods) after the completion of the image formation process, etc. In other words, an image of the referential pattern for density level detection is formed during one of the above described non-image formation periods, on the intermediary transfer belt 31, across the area which does not oppose, or does not come into contact with, a recording medium S, and the density level of this image of the referential pattern is detected. FIG. 6 is a schematic development of the photosensitive drum 10, in terms of the circumferential direction, in which referential symbols K1–K4 designate toner images, which were formed by the developing apparatus 13Bk for developing the black components, with the development bias to be applied to the development roller 16Bk of the developing apparatus 13Bk set at −250V, −300 V, −350 V, and −400 V, respectively.

Figure 7:
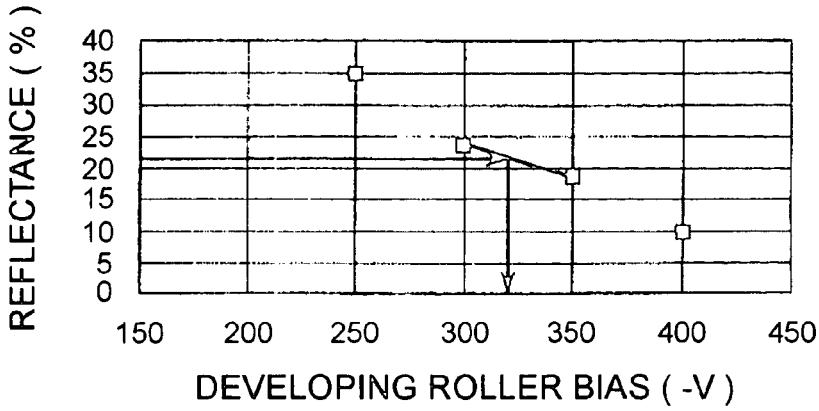
FIG. 7 is a graph for describing the method for selecting the potential level for the bias to be applied to the development roller.

FIG. 7 is a graph showing the relationship between the potential level of development bias applied during the formation of the black toner images K1–K4, and the reflectance level detected with the use of the density sensor 70. The development bias to be applied during the normal development process can be set so that the density level of the image of the density control patch T will become 1.4 (target density), for example. With the use of the graph in FIG. 7, which shows the relationship between the potential level of the development bias applied during the formation of the toner images K1–K4, and the density levels of the toner images K1–K4, it can be estimated, through linear interpolation, that the development bias level for effecting a density of 1.4 (reflectance of 22%) is −320 V. In other words, with the use of this method, it is possible to calculate the development bias level value which effects a density level of 1.4, making it possible to maintain the density level at a preferable level regardless of the ambience and the changes which occur to the apparatus due to usage. Similarly, the potential levels of the development biases to be applied to the yellow, magenta, and cyan developing apparatuses can be selected so that the target density level of 1.4, for example, can be achieved. In other words, each of the development bias voltages to be applied to a plurality of development rollers, one for one, can be individually adjusted in order to achieve a predetermined level of density.

In this embodiment, when a density of 1.4, for example, is necessary, the potential level range for the development bias (development bias potential level range for forming an image of a referential patch) in which the development bias potential level is to be selected, is desired to be no less than −250 V (roughly −250 V −−400 V). In other words, in the case of the structural arrangement in this embodiment, as long as the adjustment is made within this range, the target density of 1.4 can be achieved, regardless of all of the factors which affect image density level, for example, the temperature and humidity at which the apparatus is used, the nonuniformity in the properties of the photosensitive drum 10 and developer, the durability of the developing apparatus 13, etc. Incidentally, the voltage range in which the development bias is to be adjusted is related to the potential level of a latent image, and therefore, it should be adjusted according to the settings of the dark point potential level of the photosensitive drum, or light point potential level of the photosensitive drum affected by the intensity of the laser beam.

[Blade Bias Control]

As described above, during the development process, bias is applied to both the development blade 17 and development roller 16, in each of the four color developing apparatuses 13.

Figure 14:
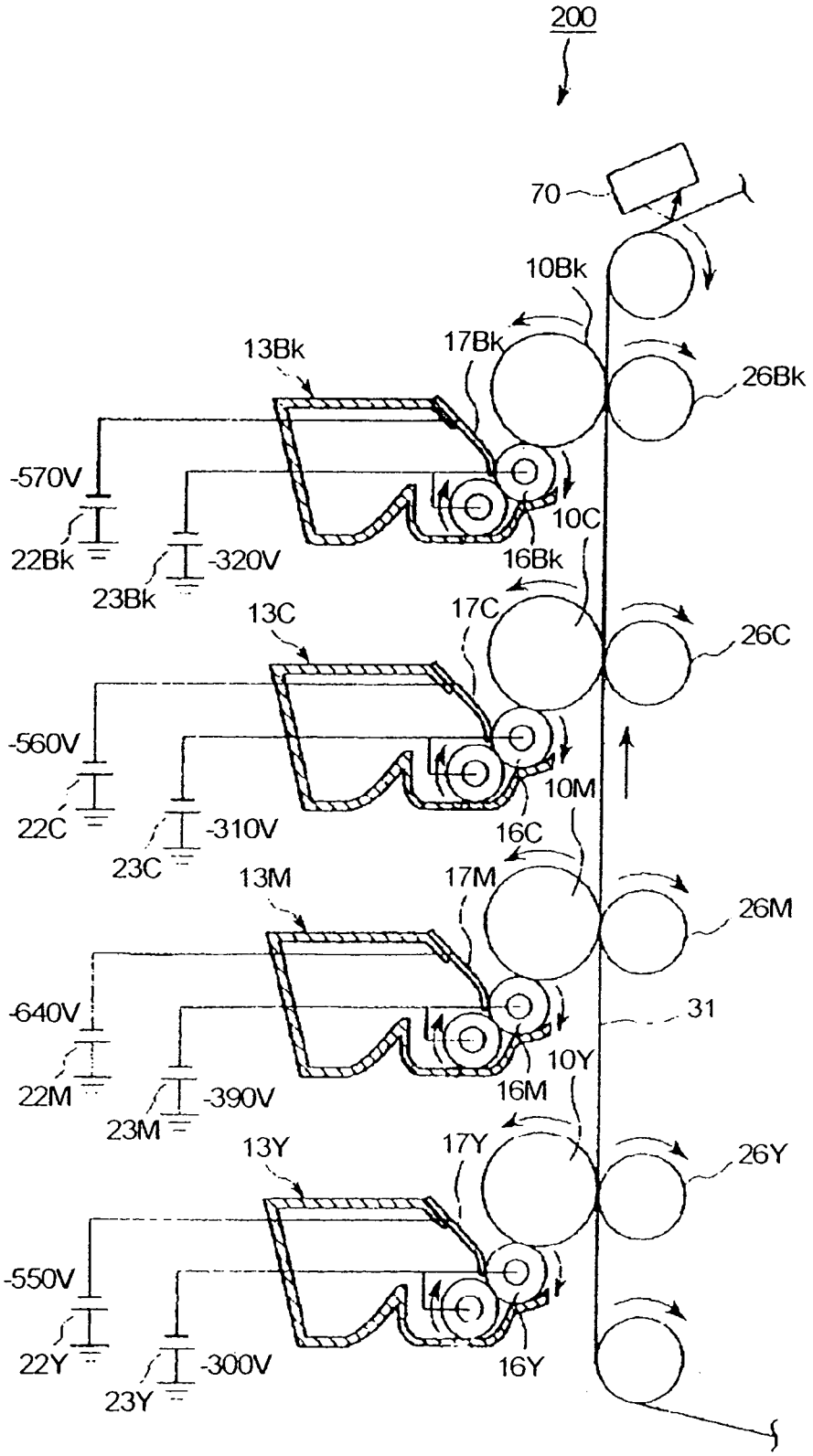
FIG. 14 is a schematic sectional view of the essential portion of the image forming apparatus shown in FIG. 13, for describing how the development bias and blade bias are applied.

First, referring to FIG. 14, which is a schematic sectional view of the essential portion, in particular, the portion comprising the photosensitive drum 10, developing apparatus 13, primary transferring means 26, and intermediary transfer belt 31, of one of the comparative image forming apparatuses, how the comparative image forming apparatus controls the image density level during the full-color print production.

As will be evident from FIG. 14, there are four high voltage power sources (blade bias power sources) 22Y, 22M, 22C, and 22 Bk for the developing apparatuses 13Y, 13M, 13C, and 13Bk, respectively. Thus, the biases to be applied to the development blades 17Y, 17M, 17C, and 17Bk can be adjusted in accordance with the biases to be applied to the development rollers 16Y, 16M, 16C, and 16Bk, respectively.

More concretely, the sum of the voltage to be applied to the development roller (16Y, 16M, 16C, and 16Bk), and −250 V, is applied as the development blade bias to the development blade (17Y, 17M, 17C, and 17Bk), respectively. With the application of such a bias to the development blade 17, it is possible to keep the negatively charged toner particles attracted toward the development roller 16, stabilizing thereby the amount by which the toner is allowed to remain in a layer on the development roller 16.

In comparison, in this embodiment, two or more (four in this embodiment) developing apparatuses 13 are allowed to share a single blade bias power source, that is, the blade bias power source 22, as shown in FIG. 3, making it unnecessary to increase the size of an electric circuit board, avoiding therefore a cost increase. In other words, this embodiment makes it possible to reduce apparatus size as well as apparatus cost. However, unlike the above described comparative example, in the case of this embodiment, it is impossible to individually adjust the blade biases to be applied with the potential levels of the development biases for the developing apparatuses 13 selected based on the detected density levels of the images of the referential density control patch T.

Thus, in this embodiment, the potential levels of the blade biases to be applied to the development blades 17Y, 17M, 17C, and 17Bk of the developing apparatuses 13Y, 13M, 13C, and 13Bk, respectively, are selected with the use of the following method.

First, referring to FIG. 8, the condition necessary for the stabilization of the amount by which toner is allowed to remain in a layer on the development roller 16 will be described. FIG. 18 shows the relationship between the difference in potential level between the development roller 16 and development blade 17, and the amount by which toner is allowed to remain in a layer on the development roller 16, by the development blade 17.

Figure 8:
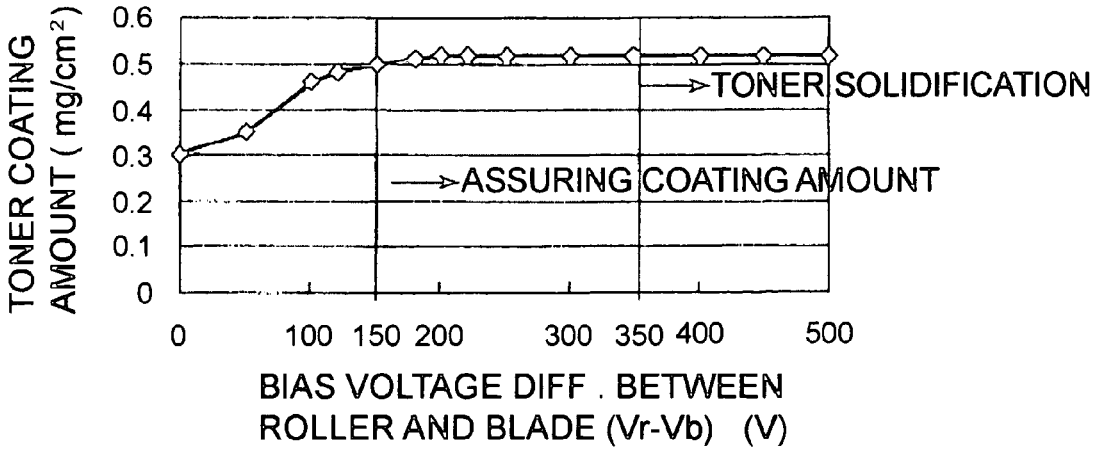
FIG. 8 is a graph for describing the conditions necessary to stabilize the amount by which toner is left coated on the development roller, by the development blade.

In FIG. 8, Vr designates the potential level of the development bias applied to the development roller 16, and Vb designates the value of the potential level of the blade bias applied to the development blade 17. As is evident from FIG. 8, the difference in potential level between the development roller 16 and development blade 17 is desired to be no less than 150 V (threshold of difference in potential level: minimum difference in potential level). In other words, it is desired that the following inequality is satisfied:

$$150\ \mathrm{V} < \mathrm{Vr}_{max} - \mathrm{Vb} \tag{1}$$

Incidentally, $\mathrm{Vr}_{max}$ in the Inequality (1) designates the potential level of the development bias largest, in absolute value (largest in negative direction), among the four development biases to be applied to the four color developing apparatuses, one for one. Hereinafter, the condition represented by Inequality (1) will be referred to as "toner coat amount stabilization condition".

On the other hand, if the difference in potential level between the development roller 16 and development blade 17 is set to be excessively large, it is possible that toner is deteriorated by the current flowing as a result of this potential level difference, solidly adhering to the development blade 17. Described more concretely, in the case of the structural arrangement in this embodiment, if the difference in potential level between the development roller 16 and development blade 17, in a preset ambience, is no less than 350 V (potential level difference threshold for solid toner adhesion: maximum potential level difference), there is the possibility of the solid toner adhesion. This condition can be expressed in the following inequality:

$$\mathrm{Vr}_{min} - \mathrm{Vb} < 350\ \mathrm{V} \tag{2}$$

Incidentally, $\mathrm{Vr}_{min}$ in Inequality (2) designates the potential level of the development bias smallest, in absolute value (closest to positive side), among the four development biases to be applied to the four color developing apparatuses, one for one. Hereinafter, the condition represented by Inequality (2) will be referred to as "solid toner adhesion prevention condition".

In this embodiment, the image forming apparatus is provided with only one high voltage power source, or the high voltage power source 22, for the multiple development blades 17. Thus, in order to find a blade bias level which can satisfy both the toner coat amount stabilization condition (Inequality (1)) and solid toner adhesion prevention condition (Inequality (2)) for all four colors, in other words, in order to find a "balanced potential level", a computation is made to narrow the range, in voltage level, for the bias to be applied to the development blades 17, with reference to the maximum and minimum values for the potential level of the development bias to be applied to each of the developing apparatuses 13, obtained by detecting the density levels of the images of the density control patch T. Then, four biases, the potential levels of which are within the narrowed range found by the computation, and are identical, are applied to the four developing apparatuses 13Y, 13M, 13C, and 13Bk, one for one.

In this embodiment, the CPU 60 adjusts the development biases by controlling the development bias power sources 23 based on the development bias levels determined through the detection of the density levels of the images of the density control referential patch T, so that development biases with the adjusted potential levels are applied to the development rollers 16. Also in this embodiment, Inequities (1) and (2), which contain the thresholds of the potential level difference between the development roller 16 and development blade 17, that is, the threshold (150 V) for the toner coat amount stabilization and the threshold (350 V) for the solid toner adhesion, are prescribed, and are stored in a storage means, for example, the storage portion of the CPU 60. With this arrangement, the CPU 60 calculates the blade bias level for each development blade, based on the potential level set for the development bias for each of the development rollers, as will be described later, and selects a blade bias level matching the calculated development roller potential level. Then, it controls the blade bias power source 22, to apply the blade bias with the selected potential level to the development blades 17. In other words, each of the voltages applied to two or more (four in this embodiment) development rollers can be individually adjusted, and the voltages applied to the development blades can be adjusted in potential level, when at least one of the voltages applied to the development rollers, one for one, is changed in potential level.

Hereinafter, the examples of the above described density control method will be described.

EXAMPLE 1

Figure 9:
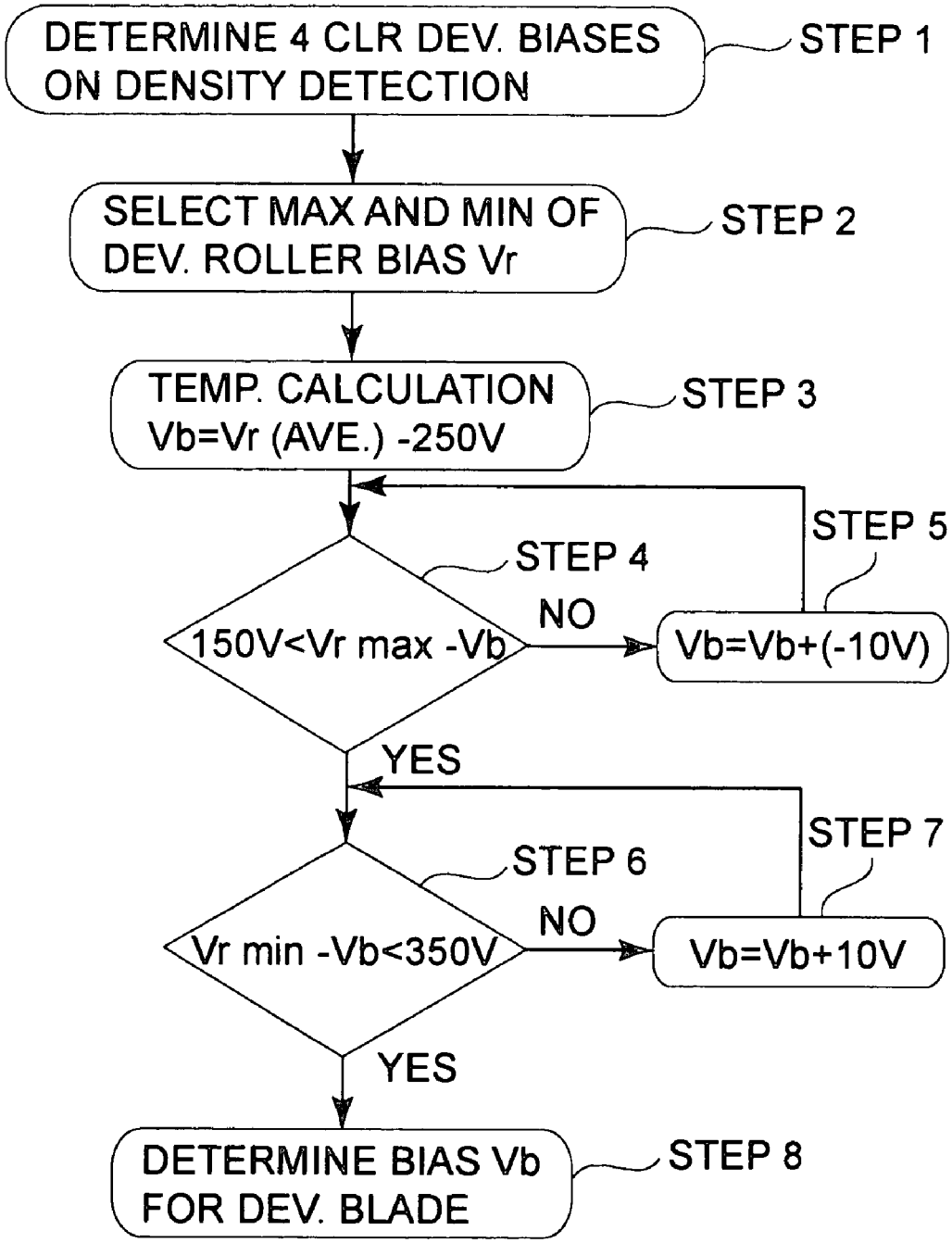
FIG. 9 is a flowchart of an example of the process for selecting the potential level for the bias to be applied to the development blade.

FIG. 9 is a flowchart showing one of the density control processes in this embodiment. The density control method will be described with reference to this flowchart.

It is assumed that −320 V, −310 V, −390 V, and −300 V were selected as the potential levels for the development biases to be applied to the four developing apparatuses, that is, black, cyan, magenta, and yellow developing apparatuses 13Bk, 13C, 13M, and 13Y, according to the density levels of the four color images of the density-control reference patches (Step 1).

In the case of the comparative example, a voltage, the potential level of which equals to the sum of the potential level of the development bias applied to the developing apparatus (13Y, 13M, 13C, and 13Bk), and 250 V, is applied as the blade bias to the development blade (17Y, 17M, 17C, and 17Bk, respectively), as described above.

In comparison, in this embodiment, first, the maximum value ($Vr_{max}$) and minimum value ($Vr_{min}$) for the potential level for the blade bias are found, from among the values selected for the potential level of the development bias to be applied to each of the developing apparatuses 13Y, 13M, 13C, and 13Bk (Step 2).

Next, a hypothetical blade bias level Vb is calculated. That is, in this embodiment, first, the average of the potential levels selected for the development biases for the four developing apparatuses is calculated, and 250 V is added to the calculated average potential level, obtaining thereby the hypothetical development blade potential level proper to allow a sufficient amount of toner to remain in a layer on the development roller 16. In other words, the value of Vb is obtained using the following arithmetic formulae (Step 3):

$$Vb=\{(-320\ \text{V})+(-310\ \text{V})+(-390\ \text{V})+(-300\ \text{V})\}\div 4+(-250\ \text{V})=-580\ \text{V}.$$

Then, the hypothetical value obtained in Step 3 and the values obtained in Step 2 are substituted for Vb, Vrmin and Vrmax in Inequities (1) and (2) to see if the two inequities are satisfied. In other words, it is determined whether or not the toner coat amount stabilization condition (Inequality (1)) is satisfied for the developing apparatus 13 which was largest (largest in terms of negative direction) in the absolute value of the development bias level (Step 4), and also, it is determined whether or not the solid toner adhesion prevention condition (Inequality (2)) is satisfied for the developing apparatus 13 which was smallest (closest to positive side) in the absolute value of the development bias level (Step 6).

In this example, both conditions are satisfied. Therefore, the above described hypothetical value (−580 V) is employed as the value for the potential levels for the blade biases to be applied to all of the developing apparatuses 13Y, 13M, 13C, and 13Bk (Step 8).

Summarized in the following table (Table 1) are the combination of the development bias values, and the blade bias values selected based thereon, in this example, and the combination of the development bias values, and the blade bias values selected based thereon, in the comparative example.

TABLE 1

Example of Bias Setting (Ave. + (−250 V))

| | EMB. | | COMP. EX. | |
|---|---|---|---|---|
| DEV. DEVICE | ROLLER | BLADE | ROLLER | BLADE |
| Bk | −320 V | −580 V | −320 V | −570 V |
| C | −310 V | | −310 V | −560 V |
| M | −390 V | | −390 V | −640 V |
| Y | −300 V | | −300 V | −550 V |

EXAMPLE 2

Next, the case in which only one of the development bias levels selected, in Step 1, for the developing apparatuses is smaller in absolute value (on positive side) than the average of the selected development bias levels, will be described. Also in this case, the value for the blade bias potential level is selected following FIG. 9. In this case however, it is necessary to prioritize the solid toner adhesion prevention condition (Inequality (2)).

For example, it is assumed that −390 V, −400 V, −400 V, and −250 V were selected as the potential levels for the development biases to be applied to the four developing rollers 16, that is, black, cyan, magenta, and yellow development rollers, according to the density levels of the four color images of the density control reference patches (Step 1).

In the case of the comparative example, a voltage, the potential level of which equals to the sum of the potential level of the development bias applied to each developing apparatus (13Y, 13M, 13C, and 13Bk) and −250 V, is applied as the blade bias to each of the development blades, as described above.

In comparison, in this embodiment, the average of the potential levels selected for the development biases for the four developing apparatuses is calculated, and −250 V is added to the calculated average potential level, obtaining thereby a hypothetical value for the potential level Vb of the bias for the development roller, proper to allow a sufficient amount of toner to remain in a layer on the development roller 16, as in the example 1. In other words, the value of Vb is obtained using the following arithmetic formulae (Step 3):

$$Vb=\{(-390\ \text{V})+(-400\ \text{V})+(-400\ \text{V})+(-250\ \text{V})\}\div 4+(-250\ \text{V})=-610\ \text{V}.$$

Next, it is determined, as in the first example, whether or not this hypothetical value for the blade bias potential level Vb satisfies Inequalities (1) and (2) (Steps 4 and 6).

In this example, the toner coat amount stabilization condition (1) can be satisfied, but the solid toner adhesion prevention condition (2) cannot be satisfied.

In other words, the difference between the lowest, in absolute value, of the development bias potential levels selected for the developing apparatuses 13, that is, the development bias potential level selected for the developing apparatus 13Y for yellow component, and the blade potential level Vb obtained through the calculation, is greater than 350 V:

$$Vr-Vb=-250-(-610\ V)=360\ V>350\ V.$$

Thus, Inequality (2) is not satisfied.

In this case, the flowchart in FIG. 9 is followed, repeating Step 6, while increasing the hypothetical blade bias level by an increment of 10 V for each repetition (Step 7), and checking whether or not the increase in blade bias level by 10 V satisfies Inequality (2), finding thereby the maximum value (−590 V) for the blade bias level that can satisfy Inequality (2). Then, the maximum value −590 V (Vb=−590 V) is selected as the value for the potential level for the bias to be applied to the blade. That is, if Vb=−590 V, Inequality (2) is satisfied for the yellow developing apparatus 13Y, which is smallest in the absolute value for the potential level of the development bias selected therefor:

$$Vr-Vb=-250\ V-(-590\ V)=340\ V<350\ V.$$

Summarized in the following table (Table 2) are the combination of the development bias values, and the blade bias values selected based thereon, in this example, and the combination of the development bias values, and the blade bias values selected based thereon, in the comparative example.

TABLE 2

Example of Bias Setting (Priority on Eq. (2))

| | EMB. | | COMP. EX. | |
|---|---|---|---|---|
| DEV. DEVICE | ROLLER | BLADE | ROLLER | BLADE |
| Bk | −390 V | −590 V | −390 V | −640 V |
| C | −400 V | | −400 V | −650 V |
| M | −400 V | | −400 V | −650 V |
| Y | −250 V | | −250 V | −500 V |

In this example, by selecting all the potential levels for the biases to be applied to the development blades of the developing apparatuses 13Y, 13M, 13C, and 13Bk as shown in Table 2, the value for the difference in potential level between the bias to be applied to the development roller 16 and the bias to be applied to development blade 17 can be set as large as possible within the potential level difference range in which toner does not solidly adhere to the development blade. For example, the potential level difference (Vr−Vb) between the bias applied to the development roller 16 and development blade 17 in the cyan and magenta developing apparatuses 13C and 13M is: Vr−Vb=−400−(−590 V)=190 V>150 V, satisfying therefore, Inequality (1): 150<Vr−Vb, affording a latitude of 40 V. By securing a proper amount of difference in potential level between the bias applied to the development roller 16 and development blade 17 as described above, it is possible to further stabilize the amount by which toner is allowed to remain in a layer on the development roller 16.

On the other hand, in the case that only one of the values selected, in Step 1, for the potential levels of the development biases is larger in absolute value (largest in negative direction) than the average of the selected development bias levels, that is, when the hypothetical value for the blade bias potential level Vb does not satisfy Inequality (1) for this developing apparatus (Step 4), it is repeatedly checked (Step 4), while adding −10 V for each check (Step 5), whether or not Inequality (1) is satisfied. With the use of this process, it is possible to select the value for the potential level of the blade bias, which satisfies Inequality (1), assuring that a proper amount of toner is allowed to remain in a layer on the development roller 16 (Step 8).

As described above, according to this embodiment of the present invention, in consideration of the stabilization of the amount by which toner is allowed to remain on the development roller 16, and the prevention of the solid toner adhesion to the development blade 17, an optimum value for the potential level of the bias to be applied to the four development blades is selected by calculation, from within the potential level range which is narrowed in accordance with the development bias level range in which a target density can be achieved. Therefore, the amount by which toner is allowed to remain on the development roller 16 can be prevented from fluctuation, without the provision of additional high voltage power sources, in other words, with the employment of only one blade bias power source, or the blade bias power source 22.

Further, if it is desired to prioritize the above described toner coat amount stabilization condition, or solid toner adhesion prevention condition, it is possible to check only the prioritized condition. More specifically, it is possible to choose such an operation mode that the CPU 60 looks up the maximum or minimum value for the potential level of the bias to be applied to the development roller 16 during development, and calculates the value for the potential level for the common bias to be applied to all of the development blades, based on the referenced maximum or minimum value for the potential level of the development bias, narrowing thereby the potential level range for the common bias to be applied to all of the development blades.

Embodiment 2

Next, another embodiment of the present invention will be described. The basic structure and operation of the image forming apparatus in this embodiment are the same as those of the image forming apparatus in the first embodiment. Therefore, the structural or operational elements of the image forming apparatus in this embodiment, which are the same as those in the first embodiment are given the same referential symbols as those given to the corresponding elements in the first embodiment, and will not be described in detail here.

In this embodiment, the image forming apparatus is provided with an ambient condition detecting means, and therefore, is capable of more strictly controlling the blade bias level, when the apparatus is operated in a high temperature environment, in which toner is more likely to solidly adhere to the development blade 17. This control, which reflects the ambient condition, assures that the solid adhesion of toner to the development blade 17 does not occur.

Figure 10:
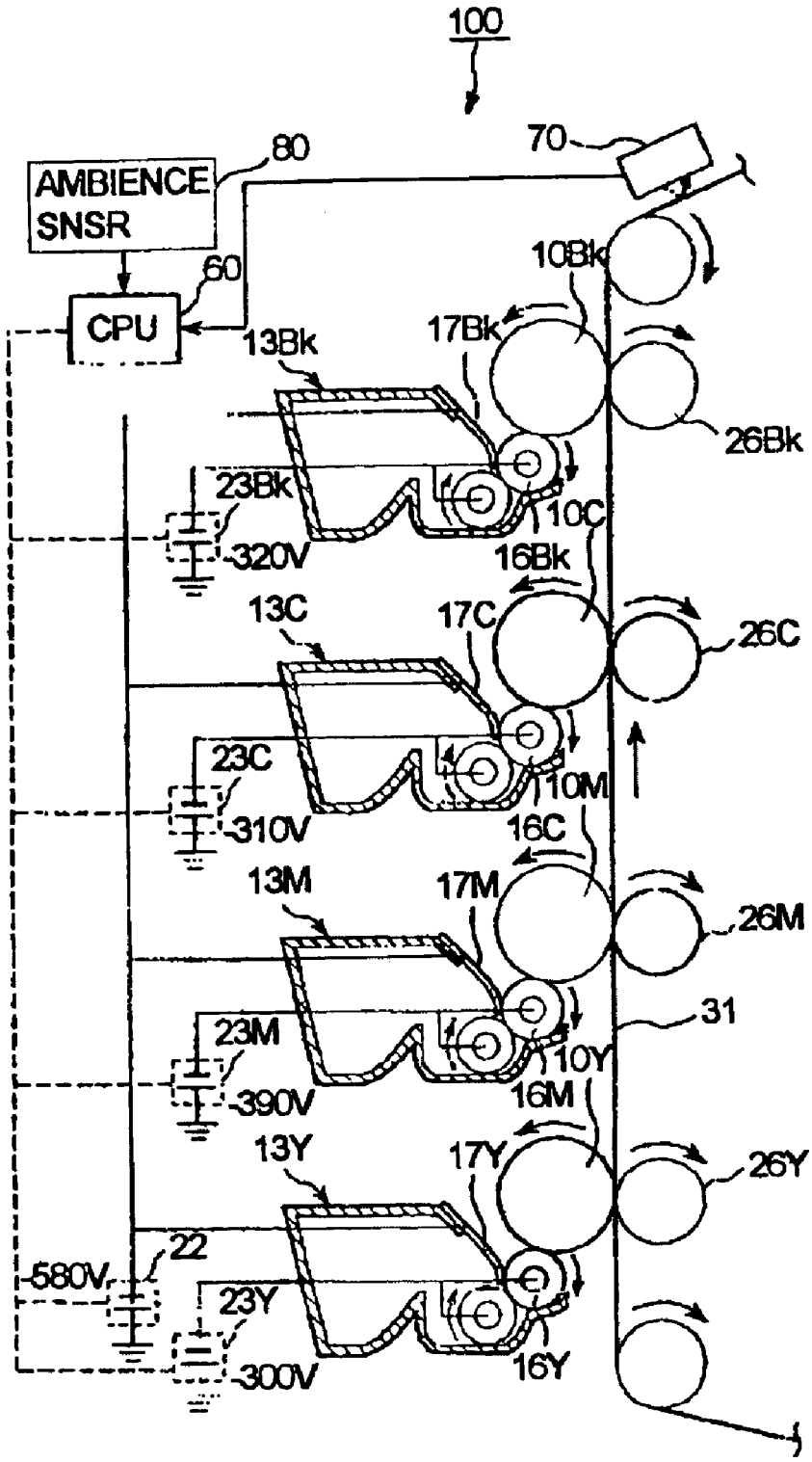
FIG. 10 is a schematic sectional view of the essential portion of the image forming apparatus in another embodiment of the present invention, for describing how the development bias and blade bias are applied in the apparatus.

Described in more detail, referring to FIG. 10, an ambience sensor (temperature-humidity sensor) 80 as an ambient condition detected means detects the state of the ambience in which the image forming apparatus 100 is placed. The solid toner adhesion to the development blade, for which the blade bias is responsible, is more likely to occur when the ambient temperature is higher, as well as when current flow is smaller.

In this embodiment, therefore, the threshold (350 V) in Inequality (2), or the solid toner adhesion prevention condition, in the first embodiment, is changed based on the temperature data from the ambience sensor 80.

More concretely, when the ambient temperature was no less than 30° C., the ambient temperature of the development roller 16 exceeded 53° C., making it likely for the solid toner adhesion to occur. Thus, the solid toner adhesion threshold (V factor) set up, as the referential value for the difference in potential level between the development roller 16 and development blade 17, to prevent the solid toner adhesion, was reduced to 330 V in response to the ambience. This stopped the occurrence of the solid toner adhesion. This condition for preventing the solid toner adhesion can be expressed in the form of the following inequality:

$$Vr-Vb<330\ V \text{ (threshold reflective of ambience: no less than 30° C.)} \quad (3).$$

On the other hand, when the ambient temperature was no more than 23° C., the ambient temperature of the development roller 16 remained below 45° C., making it unlikely for the solid toner adhesion to occur. As the difference (reflective of ambience) in potential level between the bias applied to the development roller 16 and the bias applied to the development blade 17 was reduced to a value no more than 400 V, the solid toner adhesion stopped. This condition for preventing the solid toner adhesion can be expressed in the form of the following inequality:

$$Vr-Vb<400\ V \text{ (threshold reflective of ambience: no less than 30° C.)} \quad (4).$$

Also in this embodiment, when the ambient temperature is between 23–30° C., the threshold for the difference (reflective of ambience) in potential level between the bias to be applied to the development roller 16 and the bias to be applied to the development blade 17 was set to 356 V. This condition can be expressed in the following inequity:

$$Vr-Vb<365\ V \text{ (threshold reflective of ambience: 23–30° C.)} \quad (5).$$

Figure 11:
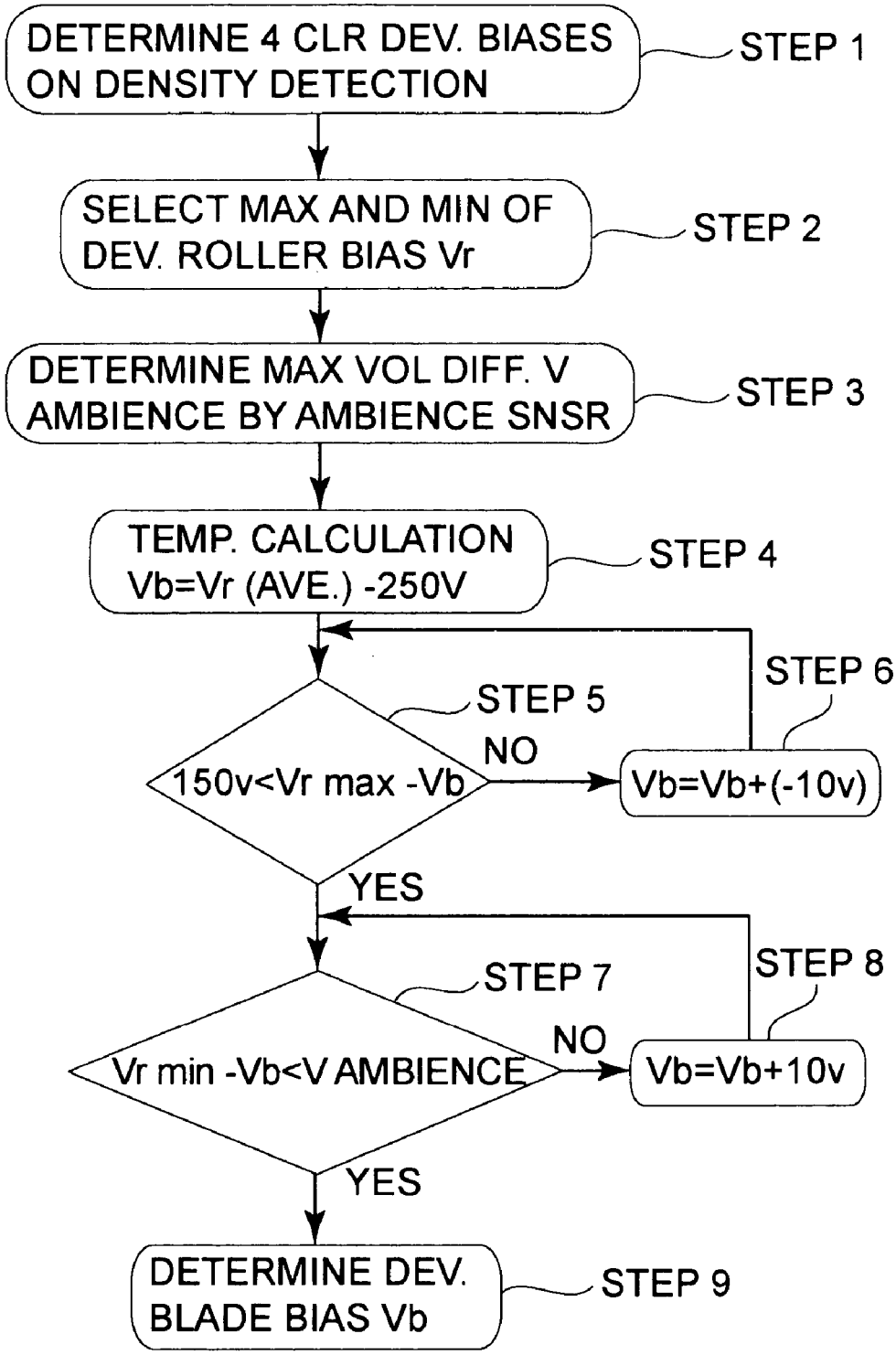
FIG. 11 is a flowchart of another example of the process for selecting the potential level for the biases to be applied to the development blade and development roller.

FIG. 11 is a flowchart for the controlling method in this embodiment. This flowchart is the same as that in the first embodiment, except that, in Step 3 in FIG. 11, the threshold reflective of the ambient temperature, which is equivalent to the potential level difference threshold (350 V) in the solid toner adhesion prevention condition (Inequality (2)) in the first embodiment, is selected in response to the ambient temperature detected by the ambience sensor 80, and in Step 7, the value for the potential level of the bias to be applied to the development blade 17 is selected in consideration of the ambient temperature.

In this embodiment, the CPU 60 holds in its storage portion as a storage means, the solid toner adhesion threshold reflective of the ambient condition, and switches the value for the solid toner adhesion threshold reflective of the ambient condition, based on the results of the detection of the ambience by the ambience sensor 80.

Described in more detail, the hypothetical value calculated in Step 4 is substituted for the blade bias level Vb, and it is determined (Step 5) whether or not the toner coat amount stabilization condition (Inequality (1)) is satisfied for the developing apparatus, which is largest (largest in negative direction) in the absolute value selected for the potential level of the development bias, or it is determined (Step 7) whether or not the solid toner adhesion prevention condition (Inequality (3), (4), or (5)) is satisfied for the developing apparatus 13, which is smallest in the absolute value of the potential level of the development bias. In Step 7, the solid toner adhesion threshold reflective of the ambient temperature, which was selected in Step 3 in accordance with the ambient condition, is used.

When both the toner coat amount stabilization condition and solid toner adhesion prevention condition are satisfied as in the first example in the first embodiment, the value obtained by the hypothetical calculation is selected as the value for the potential level of the blade bias applied to all the developing apparatuses 13Y, 13M, 13C, and 13Bk (Step 9).

Further, in the case that only one of the development bias levels selected, in Step 1, for the developing apparatuses is smaller in absolute value (on positive side) than the average of the selected development bias levels, and the hypothetical value for the blade bias potential level Vb does not satisfies the solid toner adhesion prevention condition (Inequality (3), (4), or (5) which contains the threshold reflective of the ambient condition, Step 7 is repeated after adding −10 V to the hypothetical blade bias value, in Step 8, until a value which satisfies the solid toner adhesion prevention condition is found. Then, this value is selected as the value for the potential level for the blade bias to be applied to all the developing apparatuses 13Y, 13M, 13C, and 13Bk (Step 9).

On the other hand, in the case that only one of the values selected, in Step 1, for the potential levels of the development biases is larger in absolute value (largest in negative direction) than the average of the selected development bias levels, and the hypothetical value for the blade bias potential level Vb dose not satisfy the toner coat amount stabilization condition, it is repeatedly checked (Step 5), while adding −10 V for each check (Step 6), whether or not the toner coat amount stabilization condition is satisfied, until a value which satisfies the toner coat amount stabilization condition is found. Then, if this value for the blade bias potential level Vb, which satisfies the toner coat amount stabilization condition, also satisfies the solid toner adhesion prevention condition, this value is used as the value for the potential levels for the blade biases of all the developing apparatuses 13Y, 13M, 13C, and 13Bk (Step 9).

As described above, according to the controlling method in this embodiment of the present invention, in consideration of the stabilization of the amount by which toner is allowed to remain on the development roller 16, and the prevention of the solid toner adhesion to the development blade 17, an optimum value for the potential level of the bias to be applied to the four development blades is selected by calculation, from within the the blade bias potential level range in accordance with the development bias potential level range in which a target density level can be achieved. Therefore, the amount by which toner is allowed to remain on the development roller 16 can be prevented from fluctuating, stabilizing thereby the density level at which an image is formed, without the provision of additional high voltage power sources, in other words, with the employment of only one blade bias power source, or the blade bias power source 22.

Incidentally, in this embodiment, the width of the range for the potential level of the blade bias can be controlled in response to the temperature data from the ambience sensor 80; in other words, the width of the range for the potential level of the blade bias can be narrowed (or widened with restriction). With the provision of this arrangement, it is possible to assure that the potential level of the blade bias is kept within the range, in which the amount by which toner is kept on the development roller 16 is stabilized as much as possible, while preventing toner from solidly adhering to the development blade.

Embodiment 3

Next, another embodiment of the present invention will be described. The basic structure and operation of the image forming apparatus in this embodiment are the same as those of the image forming apparatus in the second embodiment. Therefore, the structural or operational elements of the image forming apparatus in this embodiment, which are the same as those in the second embodiment are given the same referential symbols as those given to the corresponding elements in the second embodiment, and will not be described in detail here.

The image forming apparatus in this embodiment is provided with a density sensor 70, that is, a light sensor, as an image density level detecting means, and an ambience sensor (temperature-humidity sensor) as an ambient condition detecting means (FIG. 10), as is the image forming apparatus in the second embodiment. In this embodiment, however, the widths of the development bias potential level range and blade bias potential level range are optimized with the use of a controlling method different from the one in the second embodiment.

More specifically, in the second embodiment, the values for the potential levels for the development biases to be applied to the four color developing apparatuses 13Y, 13M, 13C, and 13Bk are selected through the density control process, based on the detected density levels of the images of the density control patches T, and then, the value for the potential level for the blade bias is selected, from within the blade bias potential level range restricted in accordance with the ambient factors detected with the use of the ambience sensor 80, and based on the selected development bias potential values.

In comparison, in this embodiment, first, the value for the potential level for the blade bias is selected in accordance with the data from the ambience sensor 80. Then, in accordance with the ambient condition, the development bias potential level range is selected in consideration of the bottom limit (closest to positive side), in absolute value, of blade bias potential level range in which the solid toner adhesion does not occur, and the top limit (farthest in negative direction), in absolute value, of the blade bias potential level range in which the amount by which toner is allowed to remain on the development roller 16 remains stable, in other words, the density level remains stable. Then, the values for the development bias potential level is selected from within this development bias potential level range, using the density sensor 70.

In other words, the difference in potential level between the development bias and blade bias, which can be permitted by the ambient condition is obtained in advance, as described before. Further, normally, the development bias potential level range, which is controlled in response to the density level of the image of the density control patch T detected by the image density level detecting means, is within a predetermined range. Thus, it is possible to select the value for the blade bias potential level, from within the range preset in accordance with the ambient condition, and then, the value for the development bias potential level, so that the difference in potential level between the development bias and blade bias falls within the range permissible by the ambient condition.

With the employment of such a control, not only is it possible to stabilize image density, but also, to assure that toner is prevented from solidly adhering to the development blade 17. Next, this control will be described in more detail.

Figure 12:
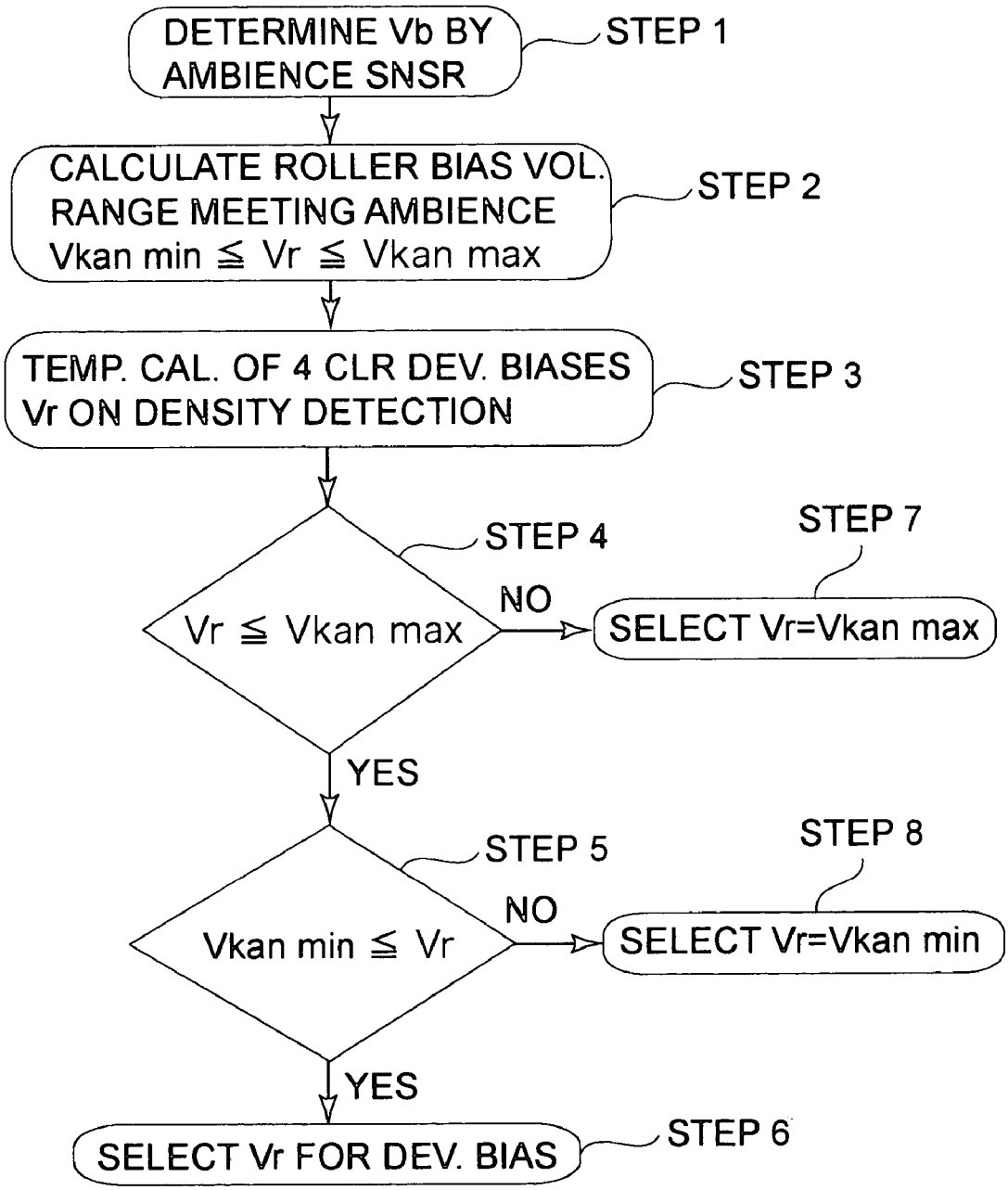
FIG. 12 is a flowchart of the another example of the process for selecting the potential level for the biases to be applied to the development blade and development roller.

FIG. 12 is a flowchart for the density control in this embodiment. First, in Step 1, the ambience sensor 80 detects the ambient temperature of the image forming apparatus 100, and then, the value for the potential level Vb for the common blade bias to be applied to the development blades 17 of all the developing apparatuses 13Y, 13M, 13C, and 13Bk, is selected in response to the ambient temperature detected by the ambience sensor 80.

As described before, the solid toner adhesion, for which blade bias is responsible, is more likely to occur when the ambient temperature is higher, as well as when current conduction is inferior. In other words, when the ambient temperature is higher, the potential level Vb of the blade bias to be applied to the development blade 17 is desired to be relatively smaller in absolute value (closer to positive side: direction to reduce amount of difference in potential level between blade bias and development bias). On the other hand, when the ambient temperature is relatively low, the absolute value of the potential level Vb of the blade bias to be applied to the development blade 17 may be on the slightly larger side (greater in negative direction: direction to increase amount of difference in potential level between blade bias and development bias).

Thus, in this embodiment, the blade bias potential level Vb is set as follows, for examples depending on the ambient temperature detected by the ambience sensor 80:

| | |
|---|---|
| no more than 23° | Vb = −570 V |
| 23–30° | Vb = −535 V |
| no less than 30° | Vb = −500 V. |

In this embodiment, the CPU holds in its storage portion as a storage means, the preset values for the blade bias potential level Vb chosen in relation to the ambient temperature data, and switches the blade bias level in response to the results of the detection by the ambience sensor 80, with reference to the present values in the storage means.

Next, in Step 2, the potential level range is set for the development bias, for each ambience range. That is, the lowest potential level $V_{kan\ min}$ of the development bias, for each ambience range, is calculated in consideration of the solid toner adhesion prevention condition. In this embodiment, 400 V (no more than 23° C.), 365 V (23–30C), and 330 (no less than 30° C.), are employed as the potential level difference threshold for the solid toner adhesion, reflective of the ambient condition, as in the second embodiment. Thus, when selecting the values for the blade bias potential levels in accordance with the ambient condition as stated above, the values Of $V_{kan\ min}$ become as follows, from the three arithmetic formulas: formulae (3) for the ambient temperature of no less than 30° C.; formulae (4) for the ambient temperature of no more than 23° C.; and formulae (5) for the temperature in the range of 23–30° C.

| | |
|---|---|
| no more than 23° | $V_{kan\ min} = 400 + (-570\ V) = -170\ V$ |
| 23–30° | $V_{kan\ min} = 365 + (-535\ V) = -170\ V$ |
| no less than 30° | $V_{kan\ min} = 330 + (-500\ V) = -170\ V.$ |

On the other hand, the maximum potential level $V_{kan\ max}$ for the development bias reflective of the ambience condition is desired to assure a voltage level of 150 V as the potential level difference between the development bias and blade bias, as described above, in consideration of the toner coat amount stabilization condition. For example, when the blade bias level is set as stated above, in consideration of the ambience condition, the values for the maximum potential level $V_{kan\ max}$ become as follows:

| | |
|---|---|
| no more than 23° | $V_{kan\ max} = -570\ V + 150 = -420\ V$ |
| 23–30° | $V_{kan\ min} = -535\ V + 150 = -385\ V$ |
| no less than 30° | $V_{kan\ min} = -500\ V + 150 = -350\ V.$ |

Thus, the ranges for the development bias level Vr reflective of the ambience become as follows:

| | |
|---|---|
| no more than 23° | $-170\ V \leqq Vr \leqq -420\ V$ |
| 23–30° | $-170\ V \leqq Vr \leqq -385\ V$ |
| no less than 30° | $-170\ V \leqq Vr \leqq -350\ V.$ |

In this embodiment, however, when it is necessary to achieve the target density level of 1.4, the potential level of the development bias is set to a value no lower than −250 V. In this case, therefore, the ranges for the development bias level Vr become as follows:

| | |
|---|---|
| no more than 23° | $-250\ V \leqq Vr \leqq -420\ V$ |
| 23–30° | $-250\ V \leqq Vr \leqq -385\ V$ |
| no less than 30° | $-250\ V \leqq Vr \leqq -350\ V.$ |

Next, in Step 3, the image density levels are detected with the use of the density sensor 70 as in the first embodiment, and the values for the potential levels for the development biases to be applied to the development rollers 16 of the developing apparatuses 13Y, 13M, 13C, and 13Bk are hypothetically set.

Thereafter, it is determined, in Step 4 and Step 5, whether or not the hypothetical values selected for the development bias potential level Vr satisfies: $V_{kan\ min} \leqq Vr \leqq V_{kan\ max}$. When the values are greater than the $V_{kan\ max}$, the maximum value ($V_{kan\ max}$) is selected as the value for the development bias potential level Vr, whereas when the values are smaller than the $V_{kan\ min}$, the minimum value ($V_{kan\ min}$) is selected as the value for the development bias potential level Vr.

In short, it is determined in Step 4 whether or not the hypothetical value for the development bias potential level Vr satisfies the ($Vr \leqq V_{kan\ max}$) portion of the development bias potential level range ($V_{kan\ min} \leqq Vr \leqq V_{kan\ max}$) calculated in Step 2 in consideration of the ambience.

If it is determined in Step 4 that the above condition is satisfied, it is determined in Step 5 whether or not the hypothetical value for the development bias potential level Vr satisfies ($V_{kan\ min} \leqq Vr$) portion of the development bias potential level range ($V_{kan\ min} \leqq Vr_{kan\ max}$) calculated in Step 2 in consideration of the ambient condition.

If it is found in Step 4 and Step 5 that the above conditions are met, the hypothetical values are employed as the values for the potential levels Vr for the development biases to be applied to the developing apparatuses 13Y, 13M, 13C, and 13Bk.

On the other hand, it is found in Step 4 that the above conditions are not satisfied, the potential level of the development bias to be applied to the developing apparatus 13 which does not satisfy the conditions is set to the maximum value ($V_{kan\ max}$) reflective of the ambient condition. Further, if it is found in Step 5 that the above conditions are not satisfied, the potential level of the development bias to be applied to the developing apparatus 13 which does not satisfy the conditions is set to the minimum value ($V_{kan\ max}$) reflective of the ambient condition, in Step 8.

Incidentally, even if the maximum value ($V_{kan\ max}$) or minimum value ($V_{kan\ min}$) reflective of the ambient condition, is selected as the value for the potential level for the development bias, there will be only a slight aberration in the density level of the solid portion of an image. Therefore, there is no problem in practical terms, because the users concerned with such an aberration carry out γ-correction with the use of a known image processing method such as dithering or the like.

The above described control method can be summarized in the following table (Table 3), which represents a case in which the values for the potential levels for the development biases to be applied to the developing apparatuses 13Y, 13M, 13C, and 13Bk are hypothetically calculated using the same method as that in Example 1 in the first embodiment (black: −320V; cyan: −310 V; magenta: −390 V, and yellow: −300 V).

TABLE 3

Example of Bias Setting using Blade Bias Control on Ambient Condition

| | AMBIENT TEMPERATURE | | | | | |
|---|---|---|---|---|---|---|
| | ≦23° C. | | 23–30° C. | | ≧30° C. | |
| | BIAS RANGE | | | | | |
| | −170—420 V | | −170—385 V | | −170—350 V | |
| | DEV. DEVICE | | | | | |
| | ROLLER | BLADE | ROLLER | BLADE | ROLLER | BLADE |
| Bk | −320 V | −570 V | −320 V | −535 V | −320 V | −500 V |
| C | −310 V | | −310 V | | −310 V | |
| M | −390 V | | −385 V | | −350 V | |
| Y | −300 V | | −300 V | | −300 V | |

As shown in Table 3, when the ambient temperature is within the range of 23–30° C., and when it is no less than 30° C., the hypothetical value (−390 V) obtained by calculation as the value for the potential level Vr for the development bias to be applied to the magenta developing apparatus 13M is greater than the maximum value ($V_{kan\ max}$) reflective of the ambient condition. Therefore, the maximum potential level values ($V_{kan\ max}$) reflective of the above two temperature ranges, that is, −385 V and −350 V, are chosen as the values for the development bias potential levels to be applied when the ambient temperature is in the above described ranges, respectively.

As described above, the blade bias potential level and development bias potential level are selected in accordance with the temperature data from the ambiance sensor 80. With this arrangement, it is assured that the potential level of the blade bias is set to a value within the range in which toner is kept on the development roller 16 by an amount proper to achieve a preferable image density level, and in which toner does not solidly adhere to the development blade.

Although the preceding embodiments were described with reference to the image forming apparatuses which employed an intermediary transfer member, the present invention is also applicable to an image forming apparatus other than those described above, for example, a full-color image forming apparatus, which is provided with a transfer medium bearing member, instead of an intermediary transfer member, and in which toner images are sequentially transferred in layers onto a transfer medium borne on the transfer medium bearing member, in the image formation stations, as the transfer medium is conveyed through the image formation stations by the transfer medium bearing member; the transfer medium is separated from the transfer bearing member; and the unfixed toner images on the transfer medium are fixed.

Further, the medium on which an image of the density control patch (referential patch) is formed to detect the density level thereof does not need to be limited to an intermediary transfer member. It may be an image bearing member such as a photosensitive member. All that is necessary when an image of the density control patch is formed on a photosensitive member is for an image of the density control patch to be formed on the photosensitive member during a period in which an actual image forming operation is not carried out (period in which photosensitive member does not come into contact with transfer medium).

It should be understood that the values, in the preceding embodiments, for the development bias, blade bias, difference in potential level between the development bias and blade bias, and range of the difference, are nothing but examples, and are not intended to limit the scope of the present invention.

Instead of a photosensitive drum, a photosensitive belt may be employed as an image bearing member. Further, instead of a photosensitive member, a dielectric member may be employed. When a dielectric member is employed, an electrostatic latent image is to be formed with the use of an ion head which directly injects electric charge.

In the first embodiment, the value for the potential level of the development bias voltage is chosen in accordance with the detected density level of the image of the density level detection referential patch, and the value for the potential level of the blade bias voltage is chosen in accordance with the chosen value for the potential level of the development bias voltage. However, the value for the potential level of the blade bias voltage may be directly chosen in accordance with the detected density level of the image of the density level detection referential patch, instead of the, value chosen for the potential level of the development bias voltage in accordance with the detected density level of the image of the density level detection referential patch.

According to the present invention, a single voltage applying means for applying voltage to a developer regulating member can be shared by two or more developer regulating members, eliminating the need for additional voltage applying means. In addition, it is possible to prevent the amount by which developer is allowed to remain on a developer bearing member, from fluctuating, stabilizing thereby the density level at which an image is formed. Also according to the present invention, not only can a single voltage applying means for applying voltage to a developer regulating member be shared by two or more developer regulating members, but also it is possible to prevent a developer bearing member from being supplied with an insufficient amount of developer, and developer from solidly adhering to the developer regulating member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a plurality of developing devices, each of which includes a developer carrying member for carrying a developer to develop an electrostatic image formed on an image bearing member with a developer and an associated developer regulating member for regulating the developer carried on said developer carrying member; and common voltage applying means for applying voltages to said developer regulating members, wherein voltages applied to said developer carrying members are variable independently from each other, and wherein when at least one of the voltages applied to said developer carrying members varies, the voltages applied by said voltage applying means to said developer regulating members are capable of being changed.

2. An apparatus according to claim 1, wherein when at least two of said plurality of developing devices are in operation, the voltages are applied to said developer carrying members associated with said at least two developing devices, and wherein said developer regulating members associated with said at least two developing devices are supplied with the voltages applied by said voltage applying means.

3. An apparatus according to claim 1, wherein the voltages applied by said voltage applying means to said developer regulating members are determined by respective voltages applied to said developer carrying members.

4. An apparatus according to claim 1, wherein the voltages applied by said voltage applying means to said developer regulating members are determined on the basis of at least one of a maximum value and a minimum value of the voltages applied to said developer carrying members.

5. An apparatus according to claim 1, wherein the voltages applied by said voltage applying means to said developer regulating members are determined on the basis of an average of the voltages applied to said developer carrying members.

6. An apparatus according to claim 1, wherein the voltages applied by said voltage applying means to said developer regulating members are determined such that potential differences between the voltages applied by said voltage applying means to said developer regulating members and one of a maximum value and a minimum value of the voltages applied to said developer carrying members are within a predetermined range.

7. An apparatus according to claim 1, wherein the voltages applied by said voltage applying means to said developer regulating members are determined such that potential differences between the voltages applied by said voltage applying means to said developer regulating members and the voltages applied to said developer carrying members are within a predetermined range.

8. An apparatus according to claim 1, wherein an assumed value of the voltages applied by said voltage applying means to said developer regulating members is determined on the basis of an average of the voltages applied to said developer carrying members, wherein when a maximum potential difference between the assumed value and the voltages applied to said developer carrying members is within a predetermined range, the assumed value is determined as being a value of the voltages applied by said voltage applying means to said developer regulating members, and wherein when the maximum potential difference is not within the predetermined range, the voltages applied by said voltage applying means to said developer regulating members are determined such that maximum potential difference is within the predetermined range by changing the assumed value.

9. An apparatus according to claim 8, wherein a determination is made as to voltages applied to said developer carrying members so as to provide a minimum potential difference between the voltages applied by said voltage applying means to said developer regulating members and the voltages applied to said developer carrying members, and when the potential difference between the thus determined voltages and the assumed value is not within a predetermined range, the assumed value is changed so that the potential difference is within the predetermined range.

10. An apparatus according to any one of claims 6 through 9, further comprising an ambient condition detecting means for detecting an ambient condition, wherein the predetermined range is determined in accordance with an output of said ambient condition detecting means.

11. An apparatus according to any one of claims 6 through 9, further comprising an ambient condition detecting means for detecting an ambient condition, wherein the voltages applied by said voltage applying means to said developer regulating members are determined in accordance with an output of said ambient condition detecting means.

12. An apparatus according to claim 1, wherein a range of the voltages applied to said developer carrying members is limited to be within a predetermined range.

13. An apparatus according to claim 12, wherein the voltages applied to said developer carrying members are determined such that potential differences between the voltages applied by said voltage applying means to said developer regulating members and the voltages applied by said developer carrying members are within a predetermined range.

14. An apparatus according to claim 1, wherein each of the voltages applied to said developer carrying members is changeable in accordance with a result of detected densities of a reference image formed by respective ones of said developer carrying members.

15. An apparatus according to claim 14, wherein the voltages applied by said voltage applying means to said developer regulating members are determined in accordance with a result of detected densities of the reference images.

16. An apparatus according to claim 14, wherein a density of the reference image is detected by formation of one of an image of said image bearing member and an image transferred onto a transfer member from said image bearing member.

17. An apparatus according to claim 1, wherein the voltages applied to said developer carrying members are DC voltages.

18. An apparatus according to claim 1, further comprising a plurality of image bearing members, which are developed by said developer carrying members, respectively.

19. An apparatus according to claim 1, wherein each one of said plurality of developing devices is provided, together with said image bearing member, in a process cartridge, assembly of the image forming apparatus.

20. An image forming apparatus comprising:

a plurality of developing devices, each of which includes a developer carrying member for carrying a developer to develop an electrostatic image formed on an image bearing member with a developer, and an associated developer regulating member for regulating the developer carried on said developer carrying member; and common voltage applying means for applying voltages to said developer regulating members, wherein the voltages applied to said developer carrying members are changeable, and wherein the voltages applied by said voltage applying means to said developer regulating members are determined on the basis of respective voltages applied to said developer carrying members.

21. An apparatus according to claim 20, wherein when at least two of said plurality of developing devices are in operation, the voltages are applied to said developer carrying members associated with said at least two developing devices, and wherein said developer regulating members associated with said at least two of said developing devices are supplied with the voltages applied by said voltage applying means.

22. An apparatus according to claim 20, wherein the voltages applied by said voltage applying means to said developer regulating members are determined on the basis of at least one of a maximum value and a minimum value of the voltages applied to said developer carrying members.

23. An apparatus according to claim 20, wherein the voltages applied by said voltage applying means to said developer regulating members are determined on the basis of an average of the voltages applied to each of said developer carrying members.

24. An apparatus according to claim 20, wherein the voltages applied by said voltage applying means to said developer regulating members are determined such that potential differences between the voltages applied by said voltage applying means to said developer regulating members and one of a maximum value and a minimum value of the voltages applied to said developer carrying members are within a predetermined range.

25. An apparatus according to claim 20, wherein the voltages applied by said voltage applying means to said developer regulating members are determined such that potential differences between the voltages applied by said voltage applying means to said developer regulating members and the voltages applied to said developer carrying members are within a predetermined range.

26. An apparatus according to claim 20, wherein an assumed value of the voltages applied by said voltage applying means to said developer regulating members are determined on the basis of an average of the voltages applied to said developer carrying members, wherein when a maximum potential difference between the assumed value and the voltages applied to said developer carrying members, is within a predetermined range, the assumed value is determined as being a value of the voltages applied by said voltage applying means to said developer regulating means, and wherein when the maximum potential difference is not within the predetermined range, the voltages applied by said voltage applying means to said developer regulating members are determined such that maximum potential difference is within the predetermined range by changing the assumed value.

27. An apparatus according to claim 26, wherein a determination is made as to the voltages applied to said developer carrying members so as to provide a minimum potential difference between the voltages applied by said voltage applying means to said developer regulating members and the voltages applied to said developer carrying members, and wherein when the potential difference between the thus determined voltages and the assumed value is not within a predetermined range, the assumed value is changed so that the potential difference is within the predetermined range.

28. An apparatus according to any one of claims 24 through 27, further comprising an ambient condition detecting means for detecting an ambient condition, wherein the predetermined range is determined in accordance with an output of said ambient condition detecting means.

29. An apparatus according to claim 20, further comprising an ambient condition detecting means for detecting an ambient condition, wherein the voltages applied by said voltage applying means to said developer regulating members are determined in accordance with an output of said ambient condition detecting means.

30. An apparatus according to claim 20, wherein each of the voltages applied to said developer carrying members, is changeable in accordance with a result of detected density of a reference image formed by a respective one of said developer carrying members.

31. An apparatus according to claim 30, wherein a density of the reference image is detected by formation of one of an image on said image bearing member and an image transferred onto a transfer member from said image bearing member.

32. An apparatus according to claim 20, wherein the voltages applied to said developer carrying members are DC voltages.

33. An apparatus according to claim 20, further comprising a plurality of image bearing members, which are developed by said developer carrying members, respectively.

34. An apparatus according to claim 20, wherein each one of said plurality of developing devices is provided, together with said image bearing member, in a process cartridge, which is detachably mountable to a main assembly of the image forming apparatus.

35. An image forming apparatus comprising:

a plurality of developing devices, each of which includes a developer carrying member for carrying a developer to develop an electrostatic image formed on an image bearing member with a developer and an associated developer regulating member for regulating the developer carried on said developer carrying member; and common voltage applying means for applying voltages to said developer regulating members, wherein each of the voltages applied to said developer carrying members is changeable in accordance with a result of a detected density of a reference image formed by a respective one of said developer carrying members, and wherein a voltage applied by said voltage applying means to said developer regulating members are determined in accordance with a result of the detected density of the reference image.

36. An apparatus according to claim 35, wherein when at least two of said plurality of developing devices are in operation, the voltages are applied to said developer carrying members associated with said developing devices, and wherein said developer regulating members associated with said at least two developing devices are supplied with the voltages applied by said voltage applying means.

37. An apparatus according to claim 35, wherein the voltages applied by said voltage applying means to said developer regulating members are determined such that potential differences between the voltages applied by said voltage applying means to said developer regulating members and one of a maximum value and a minimum value of the voltages applied to said developer carrying members are within a predetermined range.

38. An apparatus according to claim 35, wherein the voltages applied by said voltage applying means to said developer regulating members are determined such that potential differences between the voltages applied by said voltage applying means to said developer regulating members and the voltages applied to said developer carrying members are within a predetermined range.

39. An apparatus according to claim 37 or 38, further comprising an ambient condition detecting means for detecting an ambient condition, wherein the predetermined range is determined in accordance with an output of said ambient condition detecting means.

40. An apparatus according to claim 35, further comprising an ambient condition detecting means for detecting an ambient condition, wherein the voltages applied by said voltage applying means to said developer regulating means are determined in accordance with an output of said ambient condition detecting means.

41. An apparatus according to claim 35, wherein a density of the reference image is detected by one of formation of the image on said image bearing member and an image transferred onto a transfer member from said image bearing member.

42. An apparatus according to claim 35, wherein the voltages applied to said developer carrying members are DC voltages.

43. An apparatus according to claim 35, further comprising a plurality of image bearing members, which are developed by said developer carrying members, respectively.

44. An apparatus according to claim 35, wherein each one of said developing devices is provided, together with said image bearing member, in a process cartridge, which is detachably mountable to a main assembly of the image forming apparatus.

45. An apparatus comprising:

a plurality of developing devices, each of which includes a developer carrying member for carrying a developer to develop an electrostatic image formed on an image bearing member with a developer, and a developer regulating member for regulating the developer carried on said developer carrying member; and a common voltage applying means for applying a voltage to said developer regulating members, further comprising a plurality of voltage applying means for applying voltages to said developer carrying members, wherein the voltages applied to said respective said developer carrying member are independently changeable.

* * * * *

UNITED STATES PATENT AND TRADEMARK OFFICE

CERTIFICATE OF CORRECTION

PATENT NO. : 7,006,774 B2
APPLICATION NO. : 10/714636
DATED : February 28, 2006
INVENTOR(S) : Masanobu Saito et al.

It is certified that error appears in the above-identified patent and that said Letters Patent is hereby corrected as shown below:

ON THE COVER PAGE:

IN FOREIGN APPLICATION PRIORITY DATA, ITEM (30):

"2002/335837" should read --2002-335837--; and
"2003/368025" should read --2003-368025--.

IN THE ABSTRACT, ITEM (57):

Line 8, "are" should be deleted.

COLUMN 7:

Line 30, "Which" should read -- which --.

COLUMN 16:

Line 57, "formulae" should read --formula--.

COLUMN 22:

Line 50, "Of" should read --of--;
Line 51, "formulae" should read --formula--;
Line 52, "formulae" should read --formula--; and
Line 53, "formulae" should read --formula--.

COLUMN 28:

Line 6, "cartridge," should read --cartridge, which is detachably mountable to a main--.

UNITED STATES PATENT AND TRADEMARK OFFICE

CERTIFICATE OF CORRECTION

PATENT NO. : 7,006,774 B2
APPLICATION NO. : 10/714636
DATED : February 28, 2006
INVENTOR(S) : Masanobu Saito et al.

It is certified that error appears in the above-identified patent and that said Letters Patent is hereby corrected as shown below:

COLUMN 29:

Line 63, "are" should read --is--.

Signed and Sealed this

Fifth Day of September, 2006

JON W. DUDAS
*Director of the United States Patent and Trademark Office*